US009424847B2

(12) United States Patent
Ishikawa et al.

(10) Patent No.: US 9,424,847 B2
(45) Date of Patent: Aug. 23, 2016

(54) BANDWIDTH EXTENSION PARAMETER GENERATION DEVICE, ENCODING APPARATUS, DECODING APPARATUS, BANDWIDTH EXTENSION PARAMETER GENERATION METHOD, ENCODING METHOD, AND DECODING METHOD

(71) Applicant: Panasonic Corporation, Osaka (JP)

(72) Inventors: Tomokazu Ishikawa, Osaka (JP); Kok Seng Chong, Singapore (SG); Zong Xian Liu, Singapore (SG)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 14/621,885

(22) Filed: Feb. 13, 2015

(65) Prior Publication Data

US 2015/0162010 A1 Jun. 11, 2015

Related U.S. Application Data

(63) Continuation of application No. PCT/JP2013/007448, filed on Dec. 18, 2013.

(30) Foreign Application Priority Data

Jan. 22, 2013 (JP) ..... 2013-009652

(51) Int. Cl.
*G10L 19/00* (2013.01)
*G10L 21/038* (2013.01)

(52) U.S. Cl.
CPC ..... *G10L 19/00* (2013.01); *G10L 21/038* (2013.01)

(58) Field of Classification Search
None
See application file for complete search history.

(56) References Cited

U.S. PATENT DOCUMENTS

| | | | | |
|---|---|---|---|---|
| 6,356,211 | B1 | 3/2002 | Shimoyoshi et al. | |
| 7,668,711 | B2 | 2/2010 | Chong et al. | |
| 2007/0156397 | A1 | 7/2007 | Chong et al. | |
| 2007/0238415 | A1 | 10/2007 | Sinha et al. | |
| 2008/0154615 | A1* | 6/2008 | Oomen | G10L 19/24 704/500 |
| 2008/0249765 | A1* | 10/2008 | Schuijers | G10L 19/0212 704/203 |
| 2009/0132261 | A1* | 5/2009 | Kjorling | G10L 19/0017 704/500 |
| 2009/0326929 | A1* | 12/2009 | Kjorling | G10L 19/0017 704/206 |

(Continued)

FOREIGN PATENT DOCUMENTS

| | | |
|---|---|---|
| JP | 11-32399 | 2/1999 |
| JP | 2007-187905 | 7/2007 |

(Continued)

OTHER PUBLICATIONS

International Search Report issued in International Application No. PCT/JP2013/007448 on Feb. 25, 2014.

(Continued)

*Primary Examiner* — Douglas Godbold
(74) *Attorney, Agent, or Firm* — Wenderoth, Lind & Ponack, L.L.P.

(57) ABSTRACT

A bandwidth extension parameter generation device includes: a derivation unit which derives a high-band signal representing a high-band portion of an input sound signal; and a calculation unit which calculates a tone parameter and a floor parameter, the tone parameter indicating a magnitude of energy of a tone component of the high-band signal, the floor parameter indicating a magnitude of energy of a floor component obtained by subtracting the tone component from the high-band signal.

8 Claims, 13 Drawing Sheets

(56) References Cited

U.S. PATENT DOCUMENTS

| | | | | |
|---|---|---|---|---|
| 2012/0239388 | A1* | 9/2012 | Sverrisson | G10L 21/038 704/205 |
| 2013/0096930 | A1* | 4/2013 | Neuendorf | G10L 19/008 704/500 |
| 2013/0185082 | A1* | 7/2013 | Nagel | G10L 19/265 704/500 |
| 2013/0275142 | A1 | 10/2013 | Hatanaka et al. | |
| 2014/0149124 | A1* | 5/2014 | Choo | G10L 21/038 704/500 |

FOREIGN PATENT DOCUMENTS

| | | |
|---|---|---|
| JP | 2010-020251 | 1/2010 |
| WO | 2005/104094 | 11/2005 |
| WO | 2012/096230 | 7/2012 |

OTHER PUBLICATIONS

Alain B. Renaud, et al., "Networked Music Performance: State of the Art", AES 30th International Conference, Saariselkä, Finland, Mar. 15-17, 2007.

Neuendorf, et al., "MPEG Unified Speech and Audio Coding—The ISO/MPEG Standard for High-Efficiency Audio Coding of all Content Types", AES 132nd Convention, Budapest, Hungary, Apr. 26-29, 2012.

Sinha, et al., "A Novel Integrated Audio Bandwidth Extension Toolkit (ABET)", AES 120th Convention, Paris France, May 20-23, 2006.

Shuixian Chen, et al., "Estimating Spatial Cues for Audio Coding in MDCT Domain", IEEE International Conference on Multimedia and Expo, Jun. 28-Jul. 3, 2009.

Daudet and Sandler, "MDCT Analysis of Sinusoids: Exact Results and Applications to Coding Artifacts Reduction", IEEE Transactions on Speech and Audio Processing, vol. 12, No. 3, May 2004.

Rose Kenneth, et al., "Enhanced Accuracy of the Tonality Measure and Control Parameter Extraction Modules MPEG-4 HE-AAC", AES E-Library, Audio Engineering Society, Feb. 15, 2014, [URL] http://www.aes.org/e-lib/browse.cfm?elib=13340.

Frederik Nagel et al., "A Continuous Modulated Single Sideband Bandwidth Extension", Proc. ICASSP 2010, Mar. 14, 2010, pp. 357-360.

Sinha, et al., "Novel Integrated Audio Bandwidth Extension Toolkit (ABET)", AES 120th Convention, Paris France, May 20-23, 2006.

Rose Kenneth et al., "Enhanced Accuracy of the Tonality Measure and Control Parameter Extraction Modules in MPEG-4 HE-AAC", AES Convention 119; Oct. 2005, AES, 60 East 42nd Street, Room 2520 New York 10165-2520, USA, Oct. 1, 2005, XP040507430.

Extended European Search Report issued Jan. 27, 2016 in corresponding European patent application No. 13872902.5.

* cited by examiner

BANDWIDTH EXTENSION PARAMETER GENERATION DEVICE, ENCODING APPARATUS, DECODING APPARATUS, BANDWIDTH EXTENSION PARAMETER GENERATION METHOD, ENCODING METHOD, AND DECODING METHOD

CROSS REFERENCE TO RELATED APPLICATIONS

This is a continuation application of PCT International Application No. PCT/JP2013/007448 filed on Dec. 18, 2013, designating the United States of America, which is based on and claims priority of Japanese Patent Application No. 2013-009652 filed on Jan. 22, 2013. The entire disclosures of the above-identified applications, including the specifications, drawings and claims are incorporated herein by reference in their entirety.

FIELD

The present disclosure relates to, for example, an encoding apparatus and a decoding apparatus for processing a sound signal and, in particular, to a bandwidth extension technique in encoding and decoding of a sound signal.

BACKGROUND

Two kinds of tools: a core coding tool and a parametric coding tool are generally used for coding a sound signal (a speech signal and an audio signal).

A copy-up method and a harmonic method are known in a technique such as MPEG USAC (Non Patent Literature 2), as a bandwidth extension tool (BWE tool) which is one of parametric coding tools.

CITATION LIST

Non Patent Literature

[NPL 1] Carot, Alexander et al. "Networked Music Performance: State of the Art", AES 30th International Conference, 2007 Mar. 15-17.

[NPL 2] Neuendorf et al., "MPEG, Unified Speech and Audio Coding—The ISO/MPEG, Standard for High-Efficiency Audio Coding of all Content Types", AES 132nd Convention, 2012 Apr. 26-29.

[NPL 3] Sinha et al., "A Novel Integrated Audio Bandwidth Extension Toolkit" (ABET), AES 120th Convention, 2006, May 20-23.

[NPL 4] Shuixian Chen et al., "Estimating Spatial, Cues for Audio Coding in MDCT Domain", IEEE International Conference on Multimedia and Expo, 2009, Jun. 28-Jul. 3.

[NPL 5] Daudet, Sandier, "MDCT, Analysis of Sinusoids: Exact Results and Applications to Coding Artifacts Reduction", IEEE Transactions on Speech and Audio, Processing, Vol. 12, No. 3, May 2004.

SUMMARY

Technical Problem

The copy-up method is a simple method for copying the spectrum of a low-frequency portion to generate the spectrum of a high-frequency portion. The copy-up method has the problem that a harmonic relation between the two spectra cannot be accurately maintained. That is, the problem relates to sound quality.

Meanwhile, in the harmonic method, the spectrum of a low-frequency portion is harmonically stretched and cut to generate the spectrum of a high-frequency portion. The harmonic method has problems such as a long delay time and a high memory due to complicated processing.

In view of this, the present disclosure provides, for example, a bandwidth extension parameter generation device using a new bandwidth extension method.

Solution to Problem

A bandwidth extension parameter generation device according to an aspect of the present disclosure includes: a derivation unit which derives a high-band signal representing a high-band portion of an input sound signal; and a calculation unit which calculates a tone parameter and a floor parameter, the tone parameter indicating a magnitude of energy of a tone component of the high-band signal, the floor parameter indicating a magnitude of energy of a floor component obtained by subtracting the tone component from the high-band signal.

It should be noted that general and specific aspect(s) disclosed above may be implemented using a system, a method, an integrated circuit, a computer program, or a computer-readable recording medium such as a CD-ROM, or any combination of systems, methods, integrated circuits, computer programs, or computer-readable recording media.

Additional benefits and advantages of the disclosed embodiments will be apparent from the Specification and Drawings. The benefits and/or advantages may be individually obtained by the various embodiments and features of the Specification and Drawings, which need not all be provided in order to obtain one or more of such benefits and/or advantages.

Advantageous Effects

According to the bandwidth extension parameter generation device and others of the present disclosure, high-quality sound bandwidth extension can be achieved while preventing a time delay and saving a memory in use.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Figure 1:
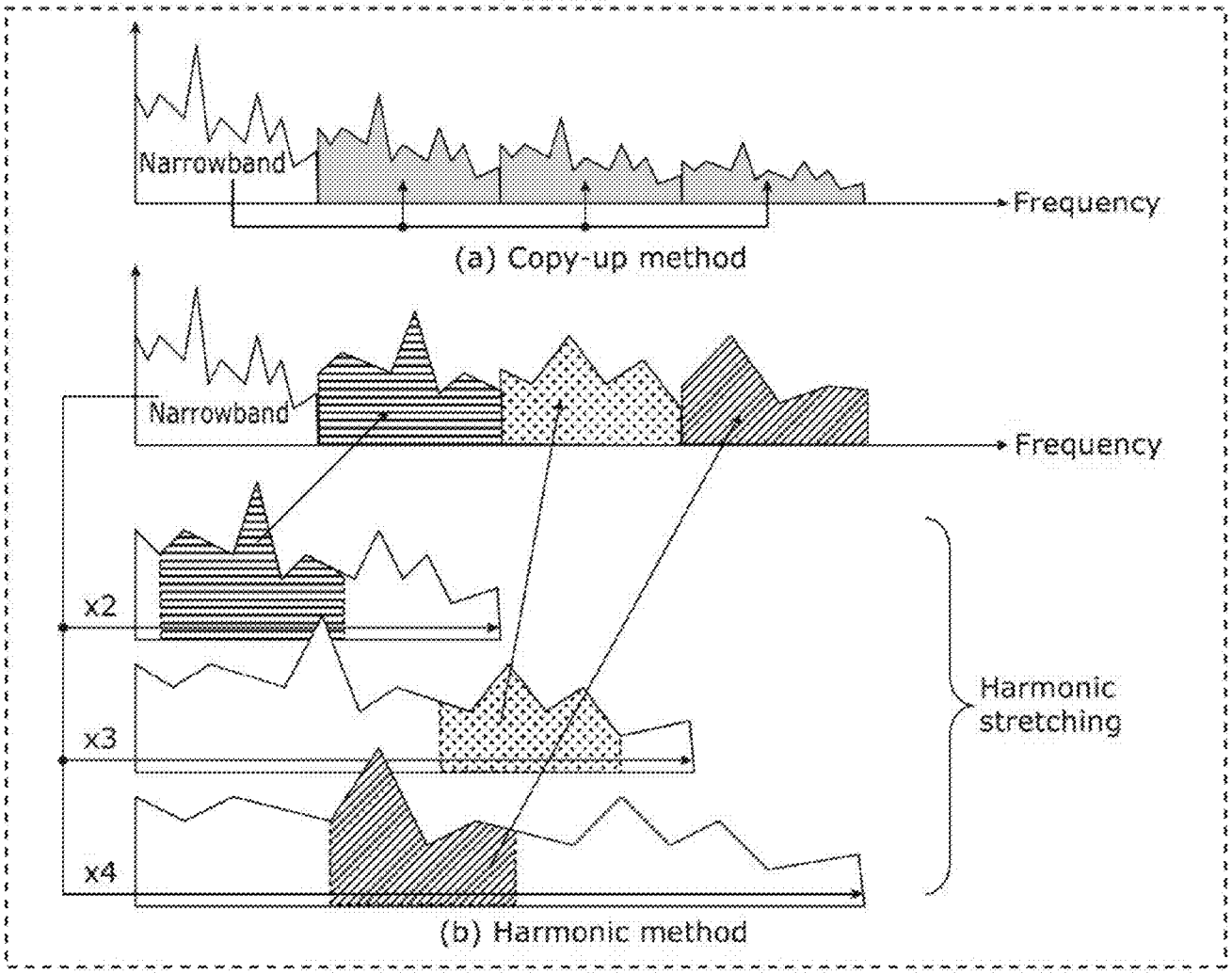
FIG. 1 is a schematic diagram for explaining a copy-up method ((a) in FIG. 1) and a harmonic method ((b) in FIG. 1).

Underlying Knowledge Forming Basis of the Present Disclosure

Generally, at least two kinds of tools: a parametric coding tool and a core coding tool are used for coding a sound signal (a speech signal and an audio signal). The following describes the parametric coding tool.

The parametric coding tool performs coding for maintaining and reconstructing the perceptual features of an input sound signal (hereinafter, also referred to as an input signal, an original signal, or a signal to be coded). Through the coding, the perceptual features of the input signal are represented by a few parameters coded at low bitrates.

A reconstructed signal obtained by decoding the signal coded by the parametric coding tool has the same perceptual quality as the input signal. However, the reconstructed signal is not similar to the input signal in waveform. The parametric coding tool includes, for example, a bandwidth extension tool and a multichannel extension tool.

The bandwidth extension tool parametrically codes a high-frequency portion of a signal by using a harmonic relation between the high-frequency portion and a low-frequency portion of the signal. Parameters (bandwidth extension parameters) generated by the coding by the bandwidth extension tool are, for example, subband energy and a tone-to-noise ratio.

The bandwidth extension parameters are used for shaping the amplitude of a signal representing a spectrally extended high-frequency portion. A decoder extends the low-frequency portion by patching or stretching, to generate the signal representing the high-frequency portion. It should be noted that the decoder appropriately compensates, for example, a floor noise and sound quality. Although a resultant output signal is not similar to the input signal in waveform, these signals are perceptually similar.

HE-AAC is a codec including such a bandwidth extension tool and spectral band replication (SBR). In the SBR, the parameters are calculated in a hybrid time-frequency domain generated using a quadrature mirror filter bank (QMF). ITU-T G.718 is also a codec having a bandwidth extension tool. However, in ITU-T G.718, the parameters are calculated in a modified discrete cosine transform (MDCT) domain.

A multichannel extension tool downmixes multiple channel signals into a subset of channels for coding. Thus, a relation between the channels is parametrically coded. Parameters generated by coding by the multichannel extension tool are, for example, an interchannel level difference, an interchannel time difference, and an interchannel correlation. The decoder synthesizes the channels by mixing decoded downmixed channels with artificially generated "decorrelated" signals. Mixing weights are calculated according to the aforementioned parameters. The MPEG surround (MPS) is a good example of the multichannel extension tool.

The following describes the core coding tool. In contrast to the parametric coding tool, the core coding tool performs coding for maintaining and reconstructing the features of the waveform of an input signal. The core coding tool is generally applied to the low-frequency portion of a spectrum, to which the human ear is most sensitive. The core coding tool is broadly categorized into an audio codec and a speech codec.

The audio codec is suitable for coding a stationary signal having a localized spectral component (e.g., tonal signal or harmonic signal). The audio codec mainly performs coding in a frequency domain.

An encoder of the audio codec transforms a signal into the frequency (spectral) domain using a time-to-frequency transform and MDCT. In the MDCT, overlapped frames are windowed.

The overlap of frames is for the decoder to perform a smoothing mechanism between adjacent frames. The two objectives of the windowing are to create a higher resolution spectrum and to attenuate boundaries of frames for smoothing.

To compensate a non-critical sampling effect caused by the overlap of the frames, time domain samples are transformed by the MDCT into a fewer number of spectral coefficients for coding. The transform causes aliasing components, which are then overlapped and cancelled out by the decoder.

The audio codec has the advantage that a psychoacoustic model can be easily applied. Specifically, more bits are assignable to a masking sound (masker), and fewer bits are assignable to a sound to be masked (maskee). The maskee is masked by other sound and is a sound which cannot be perceived by the human ear.

Thus, the application of the psychoacoustic model can significantly improve coding efficiency and sound quality in the audio codec. MPEG advanced audio coding (AAC) is a good example of a pure audio codec.

The speech codec is based on a model using the pitch characteristic of a vocal tract. Thus, the speech codec is suitable for coding a human voice (speech signal).

At the encoder of the speech codec, a linear prediction (LP) filter is used to obtain the spectral envelop of the speech signal, and the speech signal is coded into the coefficients of the LP filter. The speech signal is then inverse-filtered (spectrally divided) by the LP filter to generate a spectrally flat excitation signal. The generated excitation signal is usually sparsely coded by a vector quantization (VQ) scheme representing an excitation signal with a "codeword".

Apart from the linear prediction, long-term prediction (LTP) can be incorporated in the speech codec to obtain a speech in a long-term. Moreover, in the speech codec, a psychoacoustic aspect can be taken into account by applying a white filter to a speech signal before the LP.

In the speech codec, excellent sound quality can be obtained at low bitrates by sparsely coding an excitation signal. However, in the speech codec, the complex spectrum of content such as music cannot be obtained. Thus, the speech codec is unsuitable for music-like content. ITU-T adaptive multi-rate wideband (AMR-WB) is a good example of a pure speech codec.

A codec called transform coded excitation (TCX) is known as a third codec. The TCX is, for example, a combination codec of LP coding and transform coding.

In the TCX, a signal is perceptually weighted with a perceptual filter derived from the LP filter of the signal. The weighted signal is then transformed into a spectral domain (spectral coefficients), and the spectral coefficients are coded in a VQ scheme.

The TCX can be found in an ITU-T adaptive multi-rate wideband plus (AMR-WB+) codec. It should be noted that frequency transform used in the AMR-WB+ is discrete fourier transform (DFT).

With the development of the high-definition (HD) technology, the recent years have seen the use of communication devices in many areas ranging from, for example, multimedia to entertainment, in addition to communications. In response to this, there is an increasing demand for unified codecs that can handle both speech and audio.

For instance, in the MPEG, the unified speech and audio codec (USAC) has been standardized (Non Patent Literature 2). The USAC is a low bitrate codec which can combine appropriate tools among all of the above tools (AAC, LP, TCX, SBR, and MPS). Moreover, the USAC can handle speech coding and audio coding in a wide bitrate range.

The encoder of the USAC activates the MPS tool and downmixes a stereo signal into a monophonic signal. Moreover, the encoder of the USAC activates the SBR tool and reduces an all-band monophonic signal into a narrowband monophonic signal. To encode the narrowband monophonic signal, the encoder of the USAC analyzes the features of an input signal using a signal classifier, and determines which core codec (of AAC, LP, and TCX) should be activated.

A recent rise of a social networking culture sees an increase of net-savvy population who partake in social activities such as video conferencing and interactive audiovisual entertainment activities. One of activities expected to gain popularity is a networked music performance performed by users who get together from different locations via the Internet to play musical instruments, chorus, or sing a cappella.

To avoid "out of sync" perception by the human ear in such a networked music performance, the total delay of signal processing and a network must be less than 30 milliseconds (See Non Patent Literature 2).

For instance, if a delay due to echo cancellation and the network is 20 milliseconds, an allowable delay in encoding and decoding is about 10 milliseconds. Thus, preferably, a delay due to a BWE tool used in the encoding and decoding should be also a low delay.

In the USAC, a copy-up method and a harmonic method are known as the BWE tool. A difference between the two methods is in how a high-frequency spectrum is derived from a low-frequency spectrum. It should be noted that the harmonic method is newly introduced in the USAC, and improves coding of signals with a strong harmonic structure.

FIG. 1 is a schematic diagram for explaining the copy-up method and the harmonic method. As (a) in FIG. 1 illustrates, the spectrum of a low-frequency portion is directly copied as the spectrum of a high-frequency portion in the copy-up method. An operation in the copy-up method is very low complex. However, the operation in the copy-up method cannot accurately maintain a harmonic relation between the two spectra.

Meanwhile, as (b) in FIG. 1 illustrates, the harmonic method generates the spectrum of a high-frequency portion by harmonically stretching and cutting the spectrum of the low-frequency portion. This operation principle is similar to that of a phase vocoder, and involves several sub-processes of time stretching and resampling. This increases the complexity of the operation in the harmonic method.

Figure 2:
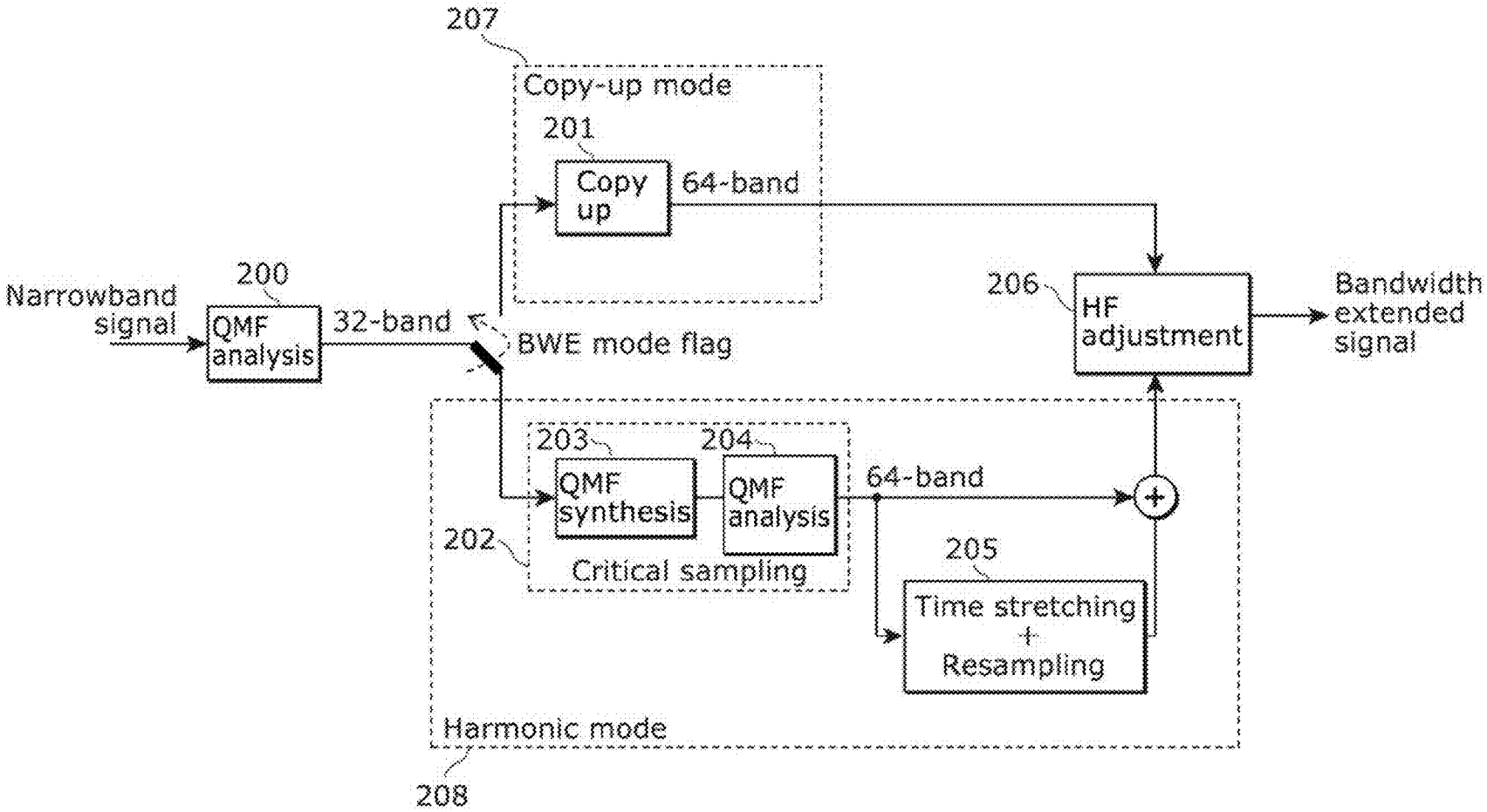
FIG. 2 is a block diagram illustrating two BWE modes in the decoder of a unified speech and audio codec (USAC).

In the USAC, these two methods are present as two BWE modes. The following describes a basic configuration of a USAC decoder. FIG. 2 is a block diagram illustrating the two BEW modes in the USAC decoder.

QMF analysis 200 is performed on a narrowband signal obtained from a core decoder, to generate a 32-band subband signal. Theoretically, based on a BWE mode flag, a copy-up mode 207 processing or a harmonic mode 208 processing may be performed on the 32-band subband signal before a high-frequency (HF) adjustment 206.

However, to maintain the interframe continuity of filtering (i.e. to continuously maintain the filter memory buffers), both modes have to be active at all times. Thus, high memories (ROM and RAM) are necessary.

Moreover, in addition to the requirements of high complexity and memory, the harmonic mode 208 requires critical sampling 202 to convert a 32-band subband signal into a 64-band subband signal.

Specifically, QMF synthesis 203 is performed for converting the 32-band subband signal into a time domain, and QMF analysis 204 is subsequently performed on a signal in the time domain, to generate a 64-band subband signal. The generated 64-band subband signal is then time-stretched and resampled (205) to generate a high-frequency portion.

Thus, in the harmonic mode 208, QMF filter bank processing in the critical sampling 202 further causes a delay in decoding.

Meanwhile, when copy-up 201 is performed in the copy-up mode 207, effects similar to those in the harmonic method are obtained for a signal having tone components spread in a wide range (weak tonality). This is because the human ear cannot differentiate tone components at the high-frequency portion.

However, as described above, in the copy-up mode 207, a harmonic relation cannot be maintained between the spectrum of the low-frequency portion and the spectrum of the copied high-frequency portion. Thus, when the copy-up mode 207 is applied to a signal with a strong harmonic structure (strong tonality), the copy-up 201 fails. It should be noted that a signal with strong tonality is generally dominated by high-energy tone components and their harmonics.

In view of this, the inventors et al. have invented a new bandwidth extension technology to address problems such as complexity, delay, and memory in the copy-up method and the harmonic method, based on the underlying knowledge.

Specifically, a bandwidth extension parameter generation device includes: a derivation unit which derives a high-band signal representing a high-band portion of an input sound signal; and a calculation unit which calculates a tone parameter and a floor parameter, the tone parameter indicating a magnitude of energy of a tone component of the high-band signal, the floor parameter indicating a magnitude of energy of a floor component obtained by subtracting the tone component from the high-band signal.

An encoding apparatus according to an aspect of the present disclosure includes: the bandwidth extension parameter generation device; an encoding unit which encodes, into a core parameter, a signal obtained by subtracting the high-band portion from the input sound signal; and a bitstream multiplexer which generates and outputs a bitstream including the tone parameter, the floor parameter, and the core parameter.

Moreover, the encoding apparatus may further include: a filtering unit which generates a narrowband signal by subtracting the high-band portion from the input sound signal; and a quadrature mirror filter (QMF) analysis unit which converts the input sound signal into a subband signal, in which the encoding unit may encode the narrowband signal into the core parameter, and the derivation unit may derive, as the high-band signal, a high-frequency (HF) subband signal representing a high-band portion of the subband signal.

Moreover, the encoding apparatus may further include: a modified discrete cosine transform (MDCT) unit which processes the input sound signal by MDCT to generate an MDCT signal; and a modified discrete sine transform (MDST) unit which processes the input sound signal by MDST to generate an MDST signal, in which the encoding unit may encode, into a core parameter, a signal obtained by subtracting from the MDCT signal a portion corresponding to the high-band portion of the input sound signal, and the derivation unit may generate a complex signal from the MDCT signal and the MDST signal, and derive a high-band portion from the complex signal as the high-band signal.

A decoding apparatus according to an aspect of the present disclosure is a decoding apparatus for decoding a bitstream including a core parameter, a tone parameter, and a floor parameter, the core parameter being a low-band portion of an encoded input sound signal, the tone parameter indicating a magnitude of energy of a tone component of a high-band signal, the floor parameter indicating a magnitude of energy of a floor component obtained by subtracting the tone component from the high-band signal, the high-band signal representing a high-band portion of the encoded input sound signal, the decoding apparatus including: a decoding unit which decodes the core parameter to generate a decoded narrowband signal; a splitter which generates a low-band tone signal representing a tone component of the decoded narrowband signal and a low-band floor signal representing a floor component of the decoded narrowband signal; a tone extension unit generates a high-band tone signal corresponding to the tone component of the high-band signal, using the low-band tone signal; a floor extension unit which generates a high-band floor signal corresponding to the floor component of the high-band signal, using the low-band floor signal; a tone adjustment unit which adjusts the high-band tone signal using the tone parameter to generate an adjusted tone signal; a floor adjustment unit which adjusts the high-band floor signal using the floor parameter to generate an adjusted floor signal; and an addition unit which adds a signal obtained from the core parameter, the adjusted tone signal, and the adjusted floor signal, to generate a bandwidth extended signal.

Moreover, the tone extension unit may generate, as the high-band tone signal, a signal representing a harmonic component of a tone component of the low-band tone signal.

Moreover, the decoding apparatus may further include a QMF analysis unit which converts the decoded narrowband signal into a subband signal, in which the splitter may split the subband signal into the low-band tone signal and the low-band floor signal, and the addition unit may add the subband signal obtained from the core parameter, the adjusted tone signal, and the adjusted floor signal, to generate the bandwidth extended signal.

Moreover, the tone extension unit may select, from among subbands of the low-band tone signal, a subband having a tone component whose energy is (i) greater than a predetermined multiple of energy of a tone component of an adjacent subband and (ii) greater than a predetermined multiple of energy of a floor component of the selected subband, and replicate the low-band tone signal corresponding to the selected subband onto a subband which is an integral multiple of the selected subband, to generate the high-band tone signal.

Moreover, the decoding apparatus may further include: a bitstream demultiplexer which generates the tone parameter, the floor parameter, and the core parameter from the bitstream; and a QMF synthesis unit which converts the bandwidth extended signal into a time domain.

Moreover, the decoding unit may (i) decode the core parameter to generate an MDCT signal, (ii) convert the MDCT signal into an MDST domain to generate an MDST signal, and (iii) generate a complex signal from the MDCT signal and the MDST signal, as the decoded narrowband signal, and the addition may add the MDCT signal obtained from the core parameter, the adjusted tone signal, and the adjusted floor signal, to generate the bandwidth extended signal.

Moreover, the tone extension unit may select, from among frequency bins of the low-band tone signal, a frequency bin having a tone component whose energy is greater than a predetermined multiple of energy of a tone component of an adjacent frequency bin, and replicate the low-band tone signal corresponding to the selected frequency bin onto a frequency bin which is an integral multiple of the selected frequency bin, to generate the high-band tone signal.

Moreover, the decoding apparatus may further include: a bitstream demultiplexer which generates the tone parameter, the floor parameter, and the core parameter from the bitstream; and an inverse modified discrete cosine transform (IMDCT) unit which converts the bandwidth extended signal into a time domain.

It should be noted that these general and specific aspects may be implemented using a system, a method, an integrated circuit, a computer program, or a computer-readable recording medium such as a CD-ROM, or any combination of systems, methods, integrated circuits, computer programs, or computer-readable recording media.

The following specifically describes embodiments with reference to the drawings.

It should be noted that each of the exemplary embodiments described below shows a general or specific example. The numerical values, shapes, materials, structural elements, the arrangement and connection of the structural elements, steps, the processing order of the steps, and others shown in the following exemplary embodiments are mere examples, and therefore do not limit the present disclosure. Therefore, among the structural elements in the following exemplary embodiments, structural elements not recited in any one of the independent claims are described as optional structural elements.

Embodiment 1

Figure 3:
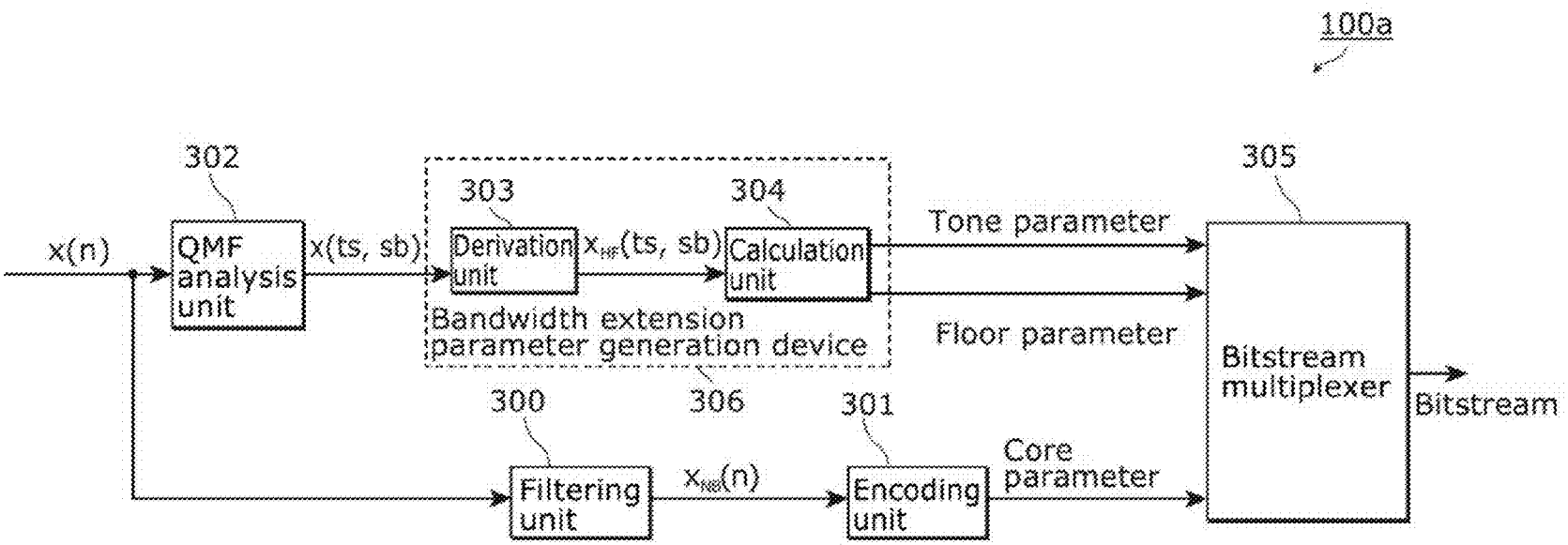
FIG. 3 is a block diagram illustrating a functional configuration of an encoding apparatus according to Embodiment 1.
Figure 4:
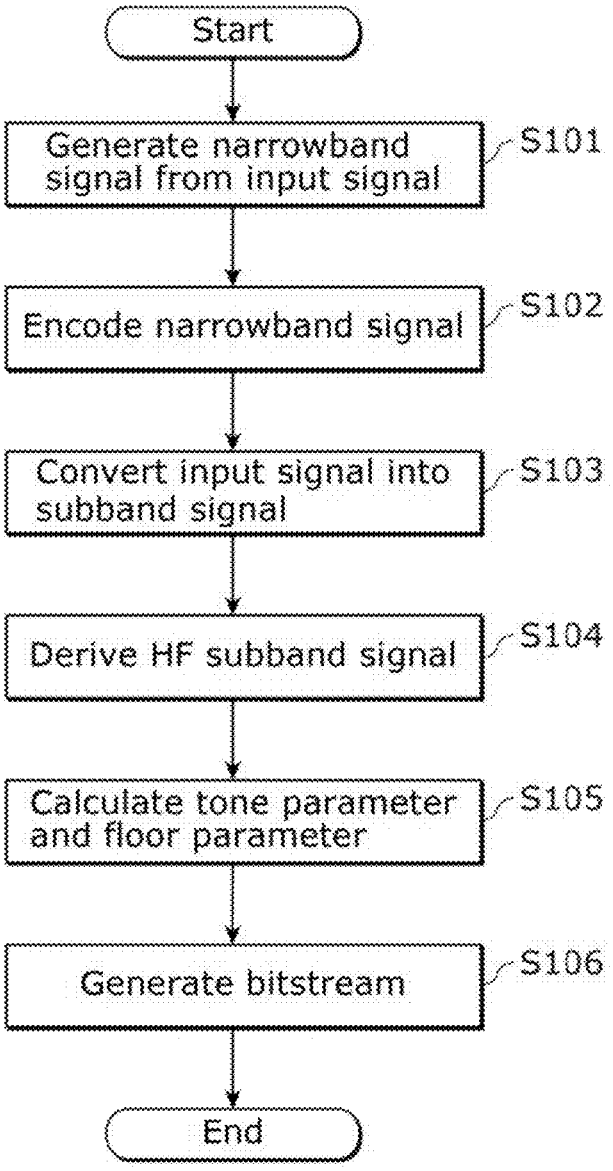
FIG. 4 is a flowchart of an operation of the encoding apparatus according to Embodiment 1.

Embodiment 1 describes an encoding apparatus using a bandwidth extension technology of the present disclosure. FIG. 3 is a block diagram illustrating a functional configuration of the encoding apparatus according to Embodiment 1. FIG. 4 is a flowchart of an operation of the encoding apparatus according to Embodiment 1.

As FIG. 3 illustrates, an encoding apparatus 100*a* according to Embodiment 1 includes a filtering unit 300, an encoding unit 301, a QMF analysis unit 302, a derivation unit 303, a calculation unit 304, and a bitstream multiplexer 305.

It should be noted that the derivation unit 303 and the calculation unit 304 are also referred to as a bandwidth extension parameter generation device 306. That is, the bandwidth extension parameter generation device 306 includes the derivation unit 303 and the calculation unit 304.

The filtering unit 300 (low pass filter) generates a narrowband signal $x_{NB}(n)$ by subtracting a high-band portion (high-frequency portion) from an input signal x(n) (S101). Here, n is a sample index. That is, the narrowband signal $x_{NB}(n)$ is a low-band portion (low-frequency portion) of the input signal x(n), and is encoded by the encoding unit 301. Meanwhile, the high-band portion of the input signal x(n) is encoded by the calculation unit 304.

The encoding unit 301 encodes the narrowband signal $x_{NB}(n)$ (a signal obtained by subtracting the high-band portion from the input signal x(n)) into a core parameter (S102). All of the core encoders of the prior art, such as the AAC, LP, and TCX are used in the encoding unit 301. For example, if the encoding unit 301 can handle speech coding and audio hybrid coding, two or more of the above core encoders are used in the encoding unit 301.

The encoding unit 301 may further include a codec switching handler which generates an additional parameter for performing smooth transition without artifacts in codec switching from one core coder to another.

The QMF analysis unit 302 (QMF analysis filter bank) converts the input signal x(n) into a subband signal X(ts, sb) in a 2M band (S103).

The derivation unit 303 derives a high-band signal representing the high-band portion of the input signal x(n). Specifically, $X_{HF}$(ts, sb) representing the high-band portion of the subband signal X(ts, sb) is derived as a high-band signal (S104). The start frequency of the high-band signal $X_{HF}$(ts, sb) corresponds to the bandwidth of the low-pass filter, i.e., the filter unit 300. Hereinafter, this start frequency (predetermined frequency) is referred to as crossover frequency $f_{xover}$. It should be noted that in the USAC, M=32.

The calculation unit 304 calculates a tone parameter and a floor parameter using the high-band signal $X_{HF}$(ts, sb) (S105). The tone parameter indicates the magnitude of energy of the tone components of the high-band signal $X_{HF}$(ts, sb). The floor parameter indicates the magnitude of energy of the floor components obtained by subtracting the tone components from the high-band signal $X_{HF}$(ts, sb).

The tone components mean peak components on a frequency axis of a sound signal, and correspond to components caused by steady and periodic vibration of a sound source. That is, the tone components are localized in a particular frequency of the sound signal, and mainly represent unique features of a sound source which emits a sound to be coded. "Strong (high) tonality" basically means that tone components have high energy.

Meanwhile, the floor components correspond to stationary noise components of a sound signal due to a stationary but aperiodic phenomenon such as a friction or turbulence, and transient noise components of the sound signal due to a non-stationary phenomenon such as a blow or an abrupt change in state of a sound source. That is, the floor components exist independently of a frequency of the sound signal.

The details of a method of calculating the tone parameter and the floor parameter by the calculation unit 304 are described later.

The bitstream multiplexer 305 combines the tone parameter, the floor parameter, and the core parameter to generate a bitstream including these parameters, and outputs the bitstream to a decoding apparatus (S106).

The following describes the details of a method of calculating bandwidth extension parameters (the tone parameter and floor parameter) by the calculation unit 304.

The high-band signal $X_{HF}$(ts, sb) is classified into parameter units (ps, pb) defined by predetermined parameter slots (ps) and parameter bands (pb). The calculation unit 304 calculates and quantizes one tone parameter and one floor parameter for each parameter unit (ps, pb).

Figure 5:
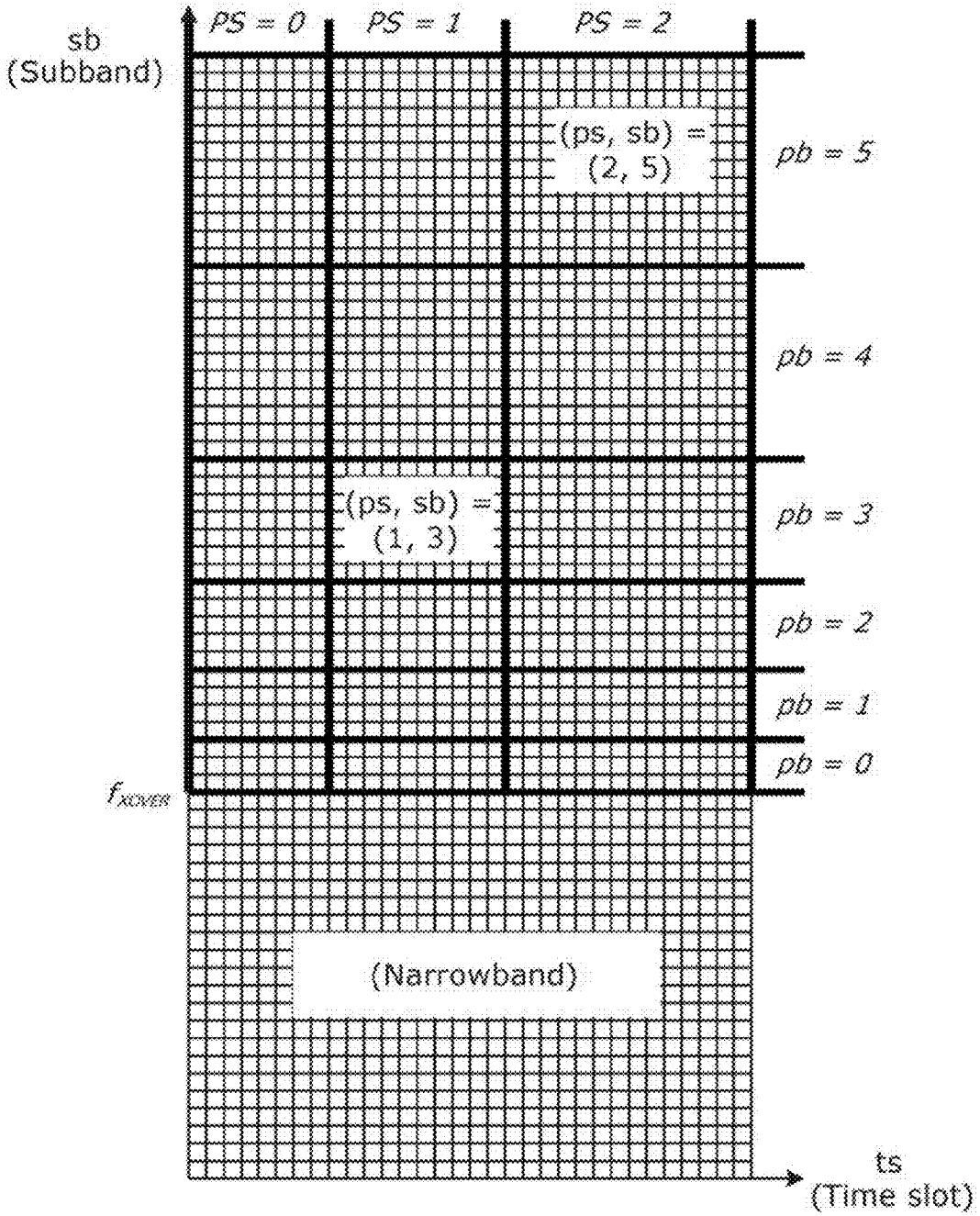
FIG. 5 illustrates a relation between a time slot and a parameter slot and a relation between a subband and a parameter band.

FIG. 5 illustrates a relation between the time slot and the parameter slot and a relation between the subband and the parameter band. Information defining relationships such as the boundaries or resolutions of the parameter bands and parameter slots may either be predetermined or dynamically calculated to form a part of the bitstream.

In Embodiment 1, the tone parameter is the energy of tone components (hereinafter, also referred to as tone energy). The floor parameter is the energy of floor components (hereinafter, also referred to as floor energy). It should be noted that the tone parameter may be any parameter if it indicates the magnitude of energy of the tone components. The floor parameter may be any parameter if it indicates the magnitude of energy of the floor components.

The calculation unit 304 calculates (estimates) the tone parameter and the floor parameter as follows using a linear prediction method.

1. The calculation unit 304 calculates covariance matrix elements for each subband sb as follows. That is, the calculation unit 304 calculates a correlation coefficient for each QMF coefficient.

[Math. 1]

$$\phi_{i,j}(ps, sb) = \sum_{ts \in ps} X_{HF}(ts - i, sb) X_{HF}^{*}(ts - j, sb) \tag{1}$$

2. The calculation unit 304 calculates linear prediction coefficients as follows.

[Math. 2]

$$\alpha_1(ps, sb) = \frac{\phi_{0,1}(ps, sb)\phi_{1,2}(ps, sb) - \phi_{0,2}(ps, sb)\phi_{1,1}(ps, sb)}{\phi_{2,2}(ps, sb)\phi_{1,1}(ps, sb) - |\phi_{1,2}(ps, sb)|^2} \tag{2}$$

[Math. 3]

$$\alpha_0(ps, sb) = -\frac{\phi_{0,1}(ps, sb) + \alpha_1(ps, sb)\phi_{1,2}(ps, sb)}{\phi_{1,1}(ps, sb)} \tag{3}$$

3. The calculation unit 304 calculates the total tone energy of a parameter unit as follows.

[Math. 4]

$$E_T(ps, pb) = \mathrm{Re}\left\{ \sum_{sb \in pb} \alpha_0(ps, sb)\phi_{0,1}^{*}(ps, sb) + \alpha_1(ps, sb)\phi_{0,2}^{*}(ps, sb) \right\} \tag{4}$$

4. The calculation unit 304 calculates the total floor energy of a parameter unit as follows.

[Math. 5]

$$E_F(ps, pb) = \sum_{sb \in pb} \phi_{0,0}(ps, sb) - E_T(ps, pb) \tag{5}$$

The tone parameter and the floor parameter calculated as above are quantized, and subsequently transmitted to the decoding apparatus as a bitstream.

It should be noted that the method of calculating the tone energy and the floor energy is not limited to the above method. The tone energy and the floor energy may be calculated by any method including the prior art.

Moreover, the tone parameter and the floor parameter may be quantized (coded) in any method such as non-linear quantization and differential coding. In this case, various quantization techniques (coding techniques) including the prior art are applicable.

Moreover, the bandwidth extension method performed by the encoding apparatus 100*a* may be achieved as a part of multi-mode coding scheme in which bandwidth extension methods including another structurally-compatible bandwidth extension method (such as a copy-up method) can be selectively performed. In such a coding method, the BWE flag indicates a preferable bandwidth extension method for each parameter unit, and is generated as a part of a bitstream.

As described above, the encoding apparatus 100*a* according to Embodiment 1 estimates the tone energy and floor energy of the high-band portion of an input signal, and generates (encodes) bandwidth extension parameters Indicating the magnitudes of the tone energy and floor energy. The decoding apparatus can generate a bandwidth extended signal similar to the input signal in energy, tone-to-floor ratio, and harmonic structure, by using the bandwidth extension parameters.

Embodiment 2

Figure 6:
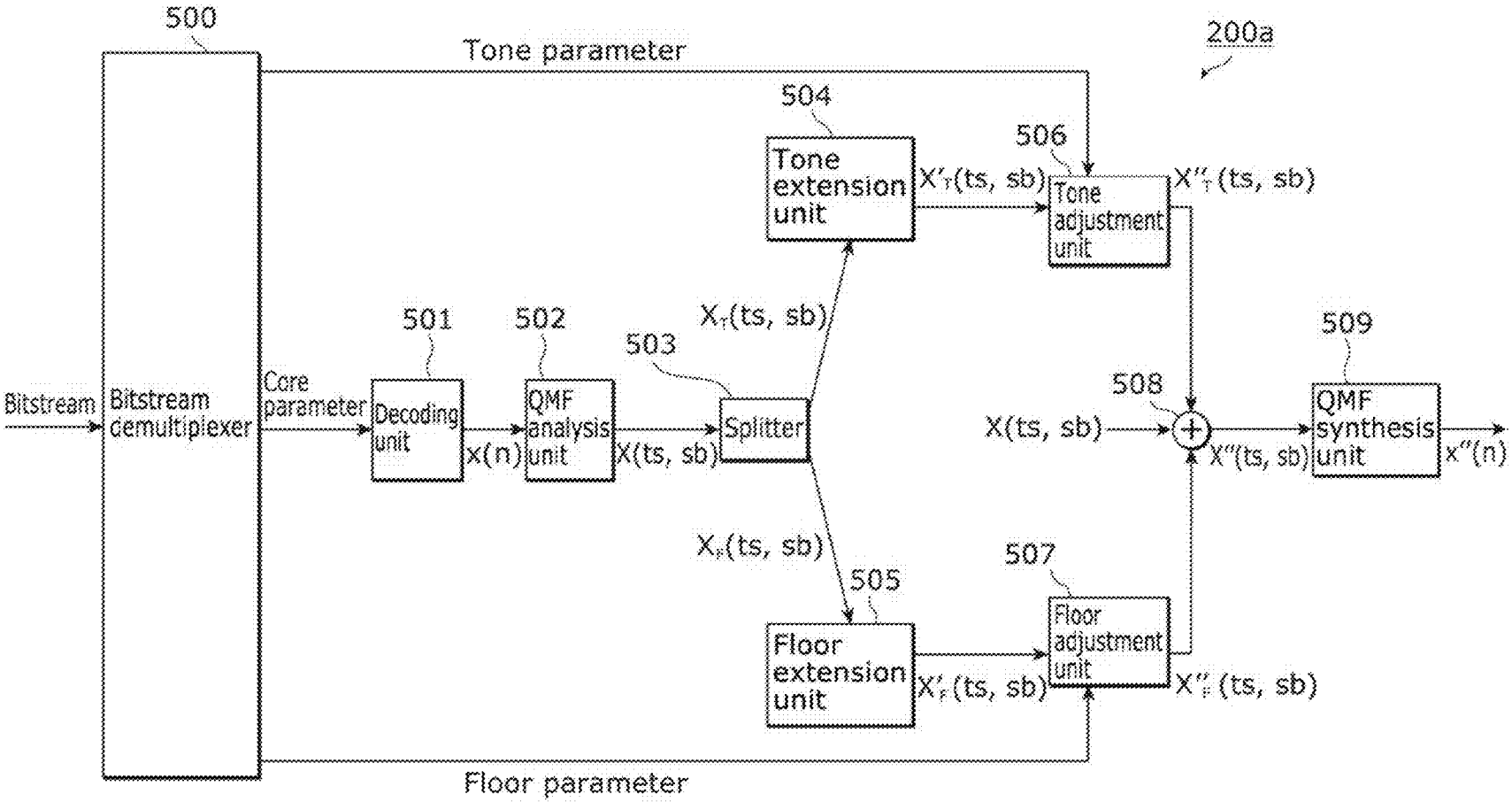
FIG. 6 is a block diagram illustrating a functional configuration of a decoding apparatus according to Embodiment 2.
Figure 7:
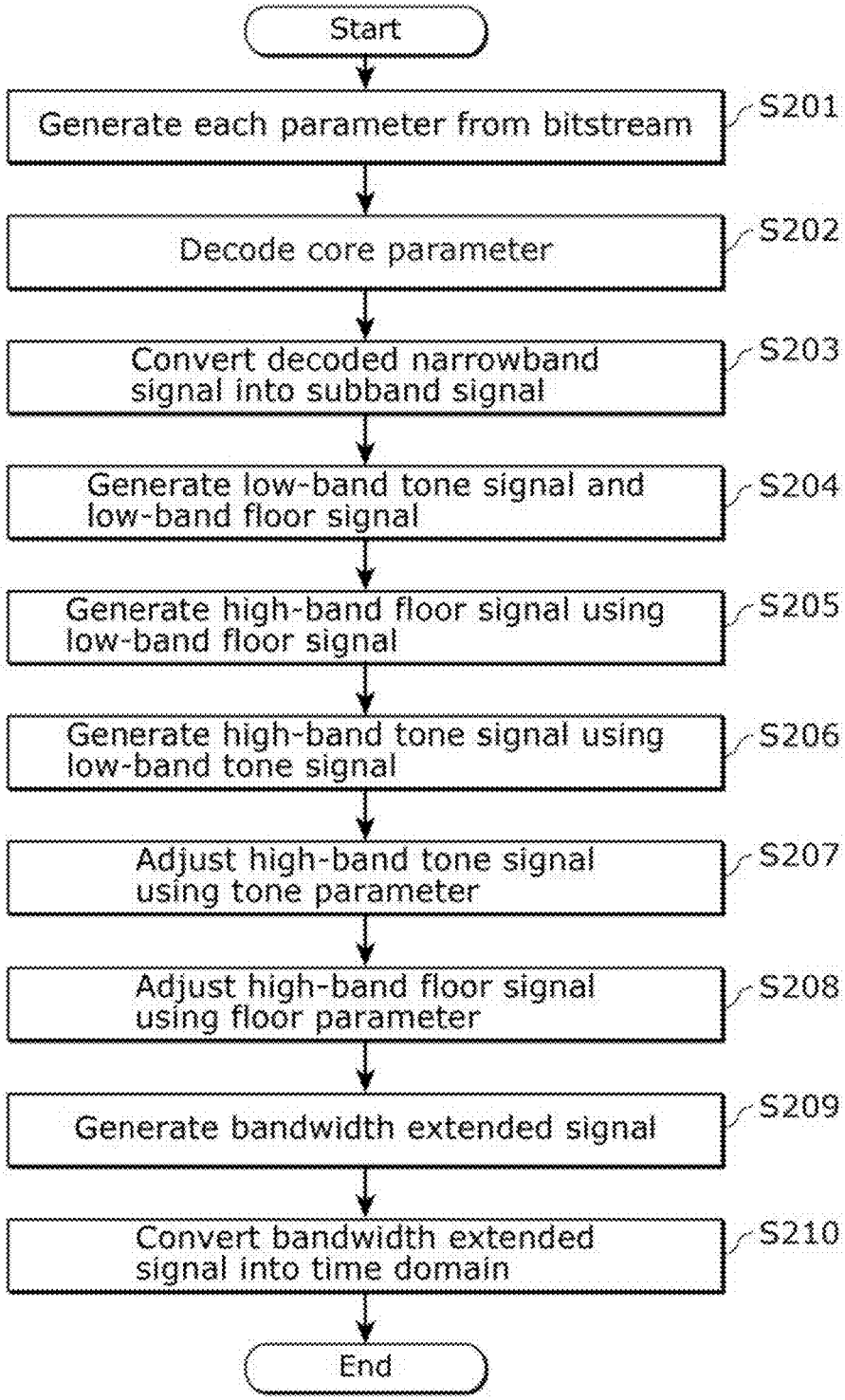
FIG. 7 is a flowchart of an operation of the decoding apparatus according to Embodiment 2.

Embodiment 2 describes a decoding apparatus corresponding to the encoding apparatus 100*a*. FIG. 6 is a block diagram illustrating a functional configuration of the decoding apparatus according to Embodiment 2. FIG. 7 is a flowchart of an operation by the decoding apparatus according to Embodiment 2.

As FIG. 6 illustrates, a decoding apparatus 200*a* includes a bitstream demultiplexer 500, a decoding unit 501, a QMF analysis unit 502, a splitter 503, a tone extension unit 504, a floor extension unit 505, a tone adjustment unit 506, a floor adjustment unit 507, an addition unit 508, and a QMF synthesis unit 509.

The bitstream demultiplexer 500 generates (derives) a tone parameter, a floor parameter, and a core parameter by unpacking a bitstream (S201).

The decoding unit 501 decodes the core parameter and generates a decoded narrowband signal x(n) (S202). All of the core decoders of the prior art, such as the AAC, LP, and TCX are used in the decoding unit 501. For instance, if the decoding unit 501 can handle speech coding and audio hybrid coding, two or more of the above core decoders are used in the decoding unit 501.

The decoding unit 501 may further include a codec switching handler for performing smooth transition without artifacts in codec switching from one core coder to another. Moreover, codec switching techniques such as windowing, addition of an overlap, and aliasing cancellation may be used in the decoding unit 501.

The QMF analysis unit 502 converts the decoded narrowband signal x(n) into a subband signal X(ts, sb) in an M-band. The upper limit of the bandwidth of the subband signal X(ts, sb) is $f_{xover}$. It should be noted that the subband signal X(ts, sb) is obtained from a core parameter.

The splitter 503 generates a low-band tone signal representing the tone components of the decoded narrowband signal x(n) and a low-band floor signal representing the floor components of the decoded narrowband signal x(n). Specifically, the splitter 503 splits the subband signal X(ts, sb) into a low-band tone signal $X_T$(ts, sb) and a low-band floor signal $X_F$(ts, sb). In Embodiment 2, the splitter 503 splits the subband signal by linear prediction and inverse filtering.

1. The splitter 503 applies expressions (1) to (5) described in Embodiment 1 to a subband signal X(ts, sb), and calculates linear prediction coefficients $a_0$(ps, sb) and $a_1$(ps, sb), tone energy $E_T$(ps, sb), and floor energy $E_F$(ps, sb).

2. The splitter 503 performs inverse-filtering on the subband signal X(ts, sb), and derives a low-band tone signal $X_T$(ts, sb) and a low-band floor signal $X_F$(ts, sb) as follows.

[Math. 6]

$$X_F(ts,sb)=X(ts,sb)+a_0(ps,sb)\cdot X(ts-1,sb)+a_1(ps,sb)\cdot X(ts-2,sb) \quad (6)$$

[Math. 7]

$$X_T(ts,sb)=X(ts,sb)-X_F(ts,sb) \quad (7)$$

3. The splitter 503 evaluates whether or not the subband sb has a high (strong) tonality, based on tone energy (the energy of the low-band tone signal $X_T$(ts, sb)). In this evaluation, a threshold can be used as an evaluation criterion. For instance, if the tone energy of the subband sb satisfies expressions (8) to (10) below, the splitter 503 evaluates that the subband sb has a high tonality.

Specifically, if the tone energy of the subband sb is $C_1$ times greater than the tone energy of an adjacent subband and $C_2$ times greater than the floor energy of the subband sb, the splitter 503 evaluates that the subband sb has a high tonality. Here, $C_1>0$, and $C_2>0$. It should be noted that as a modification example, to prevent overly dense harmonic distribution, only a subband in a band higher than a predetermined frequency may be used in harmonic extension.

[Math. 8]

$$E_T(ps,sb)>c_1\cdot E(ps,sb-1) \quad (8)$$

[Math. 9]

$$E_T(ps,sb)>c_1\cdot E_T(ps,sb+1) \quad (9)$$

[Math. 10]

$$E_T(ps,sb)>c_2\cdot E_F(ps,sb) \quad (10)$$

4. $N_T$ (for instance, three) subbands sb which are not in a harmonic relation (i.e., mutually prime subbands sb) are selected in the descending order of tone energy from among all the subbands satisfying the above criteria. Hereinafter, the selected subbands sb are referred to as tone subsets $sb_T$.

It should be noted that a method of splitting a subband signal X(ts, sb) into a low-band tone signal (tone components) and a low-band floor signal (floor components) and a method of selecting subbands sb with higher tone energy are not limited to the above methods, but any methods may be used.

Moreover, the above subbands may be evaluated and selected by the tone extension unit 504. That is, the tone extension unit 504 may select the tone subset $sb_T$ from among the subands sb of a low-band tone signal. As described above, the tone subset $sb_T$ is a subband having tone components whose energy is greater than a predetermined multiple of energy of the tone components of an adjacent subband and is greater than a predetermined multiple of the energy of the floor components of the subband (tone subset $sb_T$).

The floor extension unit 505 generates a high-band floor signal corresponding to the floor components of a high-band signal $X_{HF}$(ts, sb) (i.e., the high-band portion of an input signal), using a low-band floor signal $X_F$(ts, sb) (S205). Specifically, the floor extension unit 505 patches the low-band floor signal $X_F$(ts, sb) to a high-frequency portion, to generate a high-band floor signal (patched floor signal) $X'_F$(ts, sb).

In Embodiment 2, the copy-up method used in HE-AAC is used in generation of a high-band floor signal $X'_F(ts, sb)$. If a function map( ) is a patching function which copies a subband at map(sb) onto a subband sb in a high frequency domain, the patching is represented by the following expression.

[Math. 11]

$$X'_F(ts,sb)=X_F(ts,\mathrm{map}(sb)),\ \text{for } sb>f_{xover} \tag{11}$$

The tone extension unit 504 generates a high-band tone signal (extended tone signal) corresponding to the tone components of the high-band signal $X_{HF}(ts, sb)$ (i.e., the high-band portion of the input signal), using a low-band tone signal $X_T(ts, sb)$ (S206). Specifically, the tone extension unit 504 generates a high-band tone signal $X'_T(ts, sb)$ by harmonically extending the low-band tone signal $X_T(ts, sb)$ to a high-frequency domain. Here, the meaning of harmonically is to maintain a relation between fundamental waves and harmonics.

In Embodiment 2, the tone extension unit 504 uses the following harmonic extension method.

1. The tone extension unit 504 replicates (copies) strong tone components located at a tone subset sb, onto the high-frequency domain, according to integer harmonic ratios (e.g., 2, 3, 4). The following pseudo code indicates a replication operation. It should be noted that a maximum harmonic ratio (e.g. 4) can be set in the following expression.

[Math. 12]

$$X'_T(ts, sb) = 0; \tag{12}$$

for $sb \in sb_T$ for $i = 2$ to $\lfloor 2M/sb \rfloor$ // integer harmonic ratios 2, 3, 4, 5 … etc if $(sb \cdot i > f_{xover})$ $X'_T(ts, sb \cdot i) = X'_T(ts, sb \cdot i) + X_T(ts, sb)$ end end It should be noted that unlike the harmonic method in the harmonic mode described with reference to FIG. 2, QMF filter bank processing (QMF synthesis 203 and QMF analysis 204) and time stretching and resampling 205 are not performed in the harmonic extension method here. Thus, the harmonic extension method here causes a lower delay than the harmonic method in FIG. 2.

2. A copy-up method using the same map(sb) function used by the floor extension unit 505 is applied to the subband sb with lower tone energy (without strong tone components).

Here, the tone components located at the tone subset $sb_T$ have been already replicated onto a high-frequency domain by the above harmonic extension method, and thus are not patched again by the copy-up method.

[Math. 13]

$$X'_T(ts,sb)=X_T(ts,\mathrm{map}(sb)),$$

$$\text{for } sb\in\{sb:sb>f_{xover}, X'_T(ts,sb)=0, \mathrm{map}(sb)\notin sb_T\} \tag{13}$$

The high-band tone signal $X'_T(ts, sb)$ and the high-band floor signal $X'_F(ts, sb)$ are expected to have more than M bands and less than 2M bands.

Thus, the tone extension unit 504 generates, as a high-band tone signal, a signal representing harmonic components of the tone components of a low-band tone signal.

The tone adjustment unit 506 adjusts the high-band tone signal $X'_T(ts, sb)$ using the tone parameter to generate an adjusted tone signal $X''_T(ts, sb)$ (S207). In Embodiment 2, the tone parameter is tone energy $E_T(ps, pb)$ defined for each parameter unit (ps, pb), and the high-band tone signal $X'_T(ts, sb)$ is adjusted as follows.

[Math. 14]

$$X''_T(ts, sb) = X'_T(ts, sb) \cdot \sqrt{\frac{E_T(ps, pb)}{\sum_{ts\in ps,} \sum_{sb\in pb} |X'_T(ts, sb)|^2}} \tag{14}$$

That is, the tone adjustment unit 506 generates the adjusted tone signal $X''_T(ts, sb)$ by adjusting the energy of the high-band tone signal $X'_T(ts, sb)$ to tone energy indicated by the tone parameter.

If the subband signal X(ts, sb) is not tonal, the high-band tone signal $X'_T(ts, sb)$ does not have tone components in a parameter band pb in some cases. In such a case, artificial harmonics may be injected into the center of the parameter band pb prior to the adjustment operation by the tone adjustment unit 506. The following describes examples.

[Math. 15]

$$X'_T(ts,sb)=(\sqrt{-1})^{ts\ mod\ 4} \tag{15}$$

The floor adjustment unit 507 adjusts the high-band floor signal $X'_F(ts, sb)$ using a floor parameter to generate an adjusted floor signal $X''_F(ts, sb)$ (S208). In Embodiment 2, the floor parameter is floor energy $E_F(ps, pb)$ defined for each parameter unit (ps, pb), and the high-band floor signal $X'_F(ts, sb)$ is adjusted as follows.

[Math. 16]

$$X''_F(ts, sb) = X'_F(ts, sb) \cdot \sqrt{\frac{E_F(ps, pb)}{\sum_{ts\in ps,} \sum_{sb\in pb} |X'_F(ts, sb)|^2}} \tag{16}$$

That is, the floor adjustment unit 507 generates the adjusted floor signal $X''_F(ts, sb)$ by adjusting the energy of the high-band floor signal $X'_F(ts, sb)$ to floor energy indicated by the floor parameter.

It should be noted that a boundary between a parameter slot and a parameter band may be predetermined, or may be dynamically created using information included in a bitstream.

The addition unit 508 adds the subband signal X(ts, sb), the adjusted tone signal $X''_T(ts, sb)$, and the adjusted floor signal $X''_F(ts, sb)$, to generate a bandwidth extension signal X"(ts, sb) (S209).

[Math. 17]

$$X''(ts,sb)=X(ts,sb)+X''_T(ts,sb)+X''_F(ts,sb) \tag{17}$$

The QMF synthesis unit 509 (QMF synthesis filter bank) converts (inversely converts) the bandwidth extension signal X"(ts, sb) into a signal x"(n) in a time domain (S210).

It should be noted that common preprocessing may be performed on tone energy (tone parameter) and floor energy (floor parameter) prior to use. For instance, the tone energy and floor energy are compensated and (or) smoothed by a low-pass filter in one of a time slot direction and a subband direction or in the both directions.

Moreover, the degree of inverse filtering may be adjusted by multiplying the linear prediction coefficients with a certain "chirp factor".

Moreover, the bandwidth extension method performed by the decoding apparatus 200*a* may be achieved as a part of a multi-mode decoding scheme in which bandwidth extension methods including another bandwidth extension method (such as copy-up method) can be selectively performed. In such a decoding method, a BWE flag indicates a preferable bandwidth extension method for each parameter unit, and is derived from a bitstream.

As described above, the decoding apparatus 200*a* according to Embodiment 2 harmonically extends strong tone components and synthesizes the components with simply replicated floor components. This can maintain the harmonic sound quality of an input signal (original signal).

Moreover, in the bandwidth extension method performed by the decoding apparatus 200*a*, critical sampling, time-stretching, and resampling (down sampling) used in the harmonic method(s) of the prior art are inessential. Thus, according to the bandwidth extension method performed by the decoding apparatus 200*a*, complexity, delay, and memory requirements can be reduced.

Embodiment 3

Figure 8:
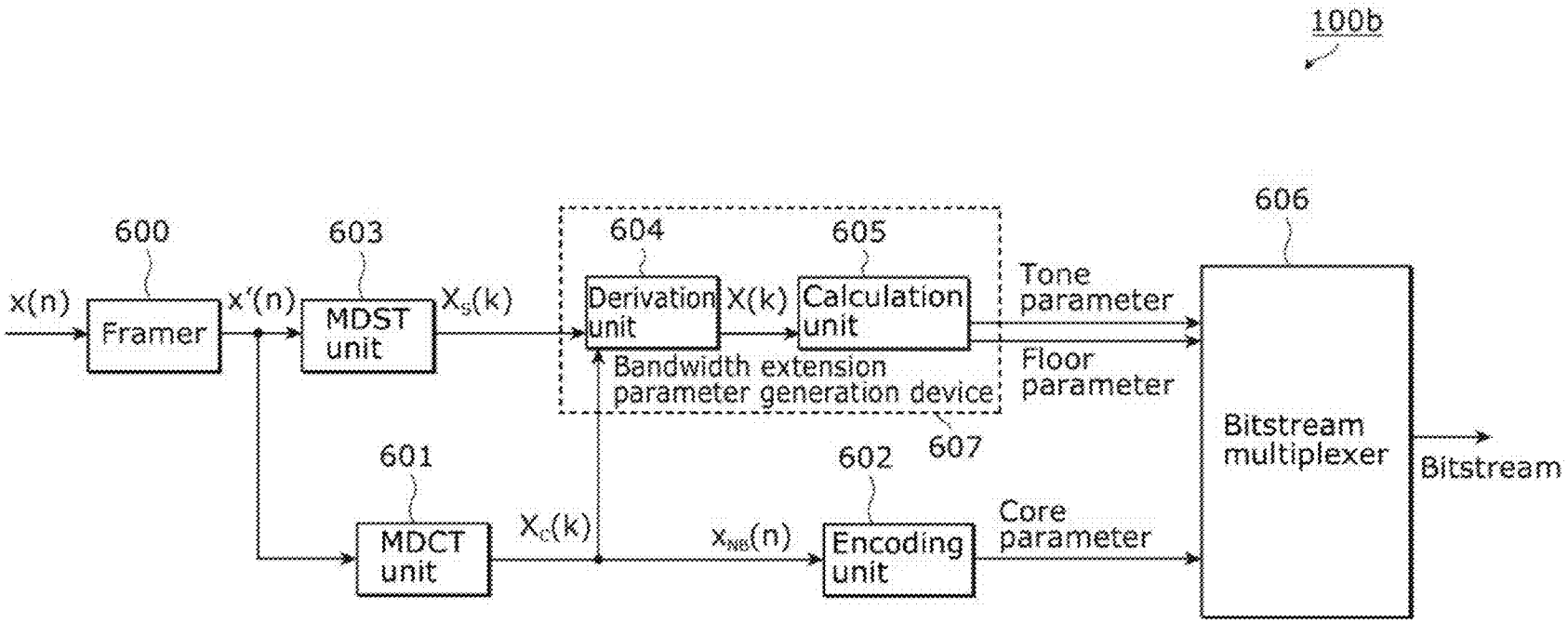
FIG. 8 is a block diagram illustrating a functional configuration of an encoding apparatus according to Embodiment 3.
Figure 9:
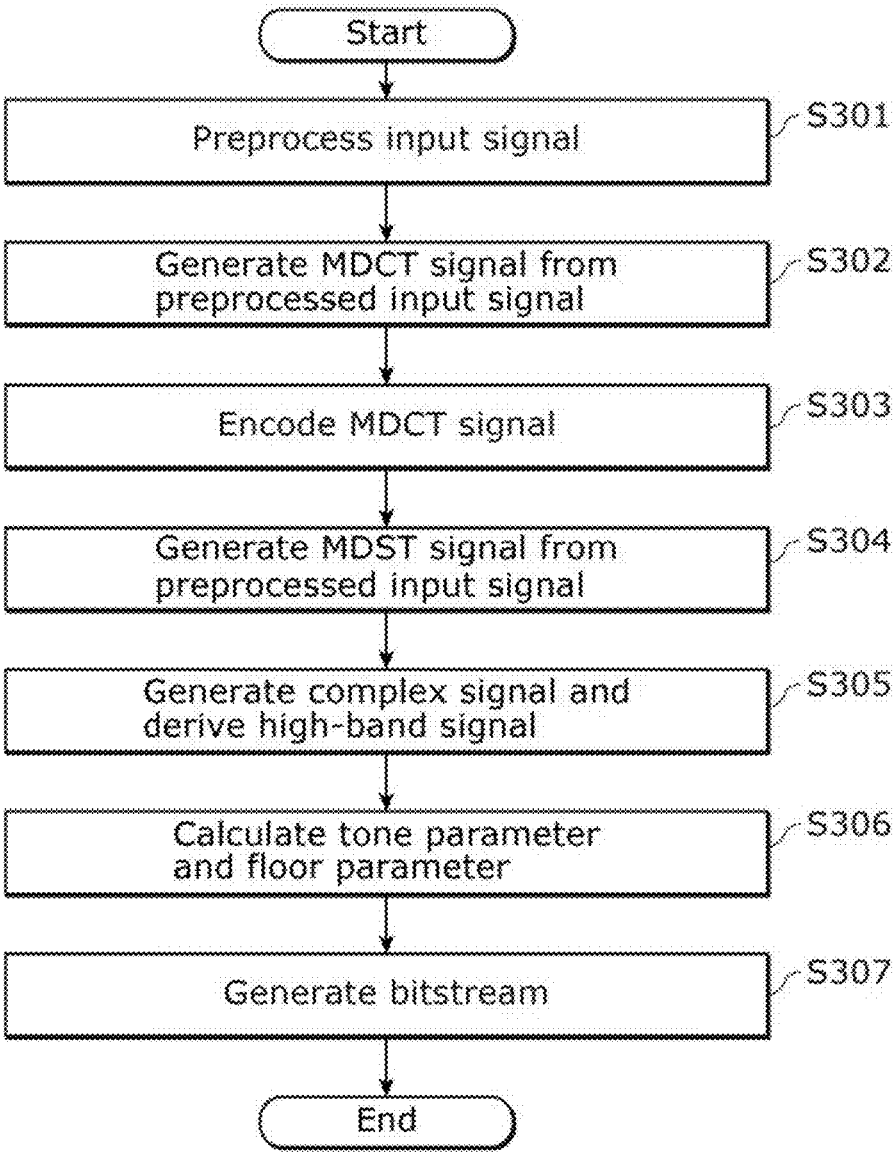
FIG. 9 is a flowchart of an operation of the encoding apparatus according to Embodiment 3.

The bandwidth extension technique of the present disclosure is also applicable to an encoding apparatus which performs MDCT. Embodiment 3 describes such an encoding apparatus. FIG. 8 is a block diagram illustrating a functional configuration of the encoding apparatus according to Embodiment 3. FIG. 9 is a flowchart of an operation of the encoding apparatus according to Embodiment 3.

As FIG. 8 illustrates, an encoding apparatus 100*b* according to Embodiment 3 includes a framer 600, an MDCT unit 601, an encoding unit 602, an MDST unit 603, a derivation unit 604, a calculation unit 605, and a bitstream multiplexer 606.

It should be noted that the derivation unit 604 and the calculation unit 605 are also referred to as a bandwidth extension parameter generation device 607. That is, the bandwidth extension parameter generation device 607 includes the derivation unit 604 and the calculation unit 605.

Figure 10:
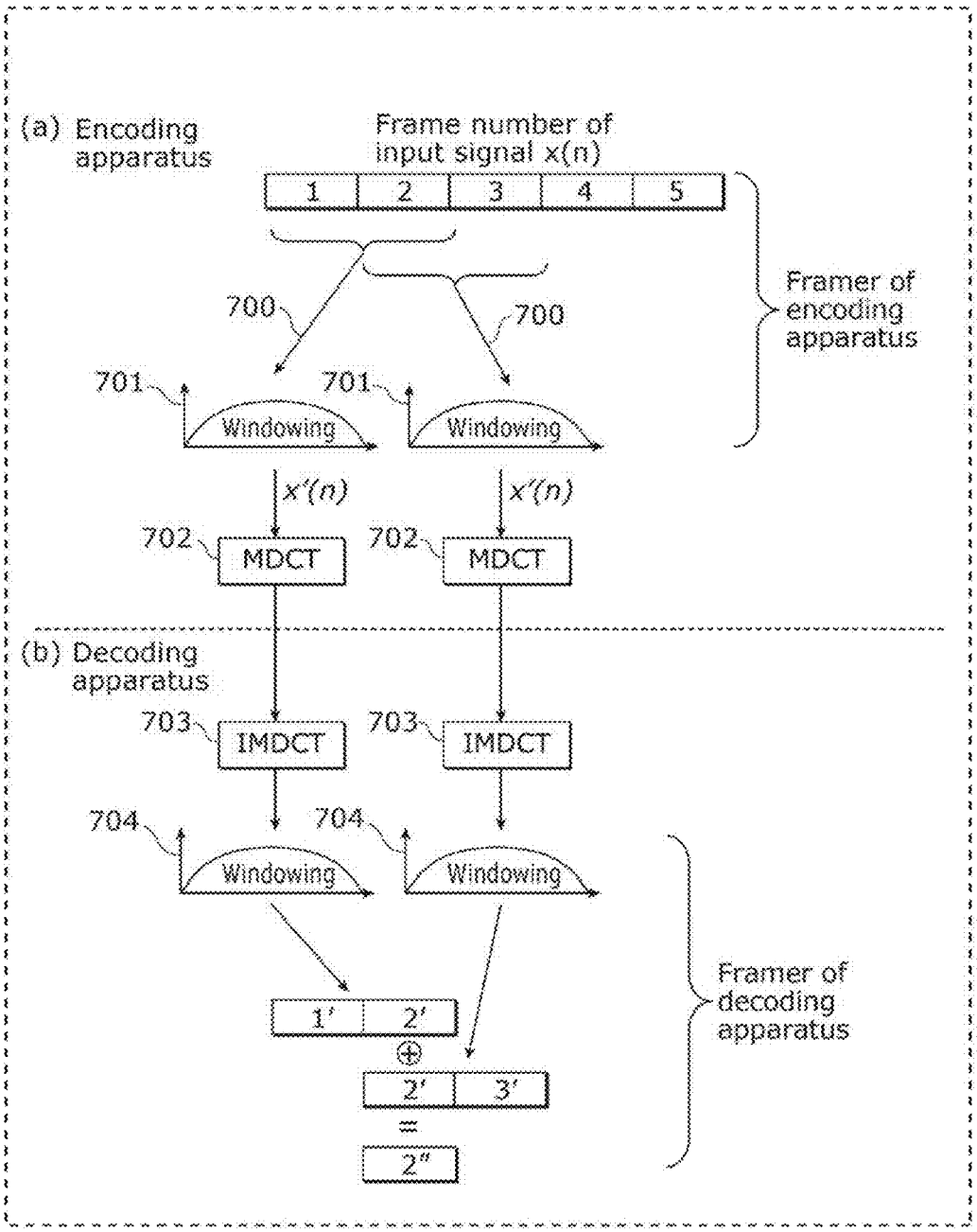
FIG. 10 illustrates framing and windowing of a framer.

The framer 600 divides an input signal into frames (performs framing), and performs windowing every predetermined number of frames, as pre-processing of the MDCT and MDST (S301). FIG. 10 illustrates the framing and windowing performed by the framer 600.

As (a) in FIG. 10 illustrates, in the windowing by the framer 600, a window function 701 is applied every two consecutive frames 700 of an input signal x(n). The frames 700 to which the window function has been applied are processed by MDCT 702 by the encoding apparatus 100*b* and, as (b) in FIG. 10 illustrates, processed by MDCT 703 by a decoding apparatus. Subsequently, the frames 700 processed in MDCT 702 and MDCT 703 are windowed 704.

The windowing has the two objectives of (i) providing a more excellent frequency resolution for encoding and (ii) providing a smoothing mechanism which prevents framing artifacts when the inversely-transformed frames are joined by the decoding apparatus. The framer 600 outputs an input signal x(n) after the preprocessing (framing and windowing), as a windowed signal x'(n).

The MDCT unit 601 generates an MDCT signal $X_c(k)$ by processing the preprocessed input signal by the MDCT (S302). Specifically, the MDCT unit 601 transforms the windowed signal x'(n) into an MDCT domain, to generate the MDCT signal $X_c(k)$. It should be noted that k is a frequency bin index (hereinafter, also simply referred to as frequency bin).

The encoding unit 602 encodes, into a core parameter, a signal obtained by subtracting from the MDCT signal $X_c(k)$, a portion corresponding to the high-band portion of the input signal x(n) (i.e., a signal obtained by subtracting the high-band portion from the input signal x(n)) (S303). That is, the encoding unit 602 encodes, into a core parameter, the MDCT signal $X_c(k)$ in a band lower than $f_{xover}$. The MDCT encoding method in the prior art used in the AAC and others is used by the encoding unit 602.

The MDST unit 603 generates an MDST signal $X_s(k)$ by processing the preprocessed input signal by the MDST (S304). Specifically, the MDST unit 603 transforms the windowed signal x'(n) into an MDST domain, to generate the MDST signal $X_s(k)$.

The derivation unit 604 generates a complex signal x(k) from the MDCT signal $X_c(k)$ and the MDST signal $X_s(k)$, and derives a high-frequency portion (high-band portion) of the generated complex signal, as a high-band signal x(k), where $k>f_{xover}$ (S305). Moreover, the derivation unit 604 derives high-frequency portions from the MDCT signal $X_c(k)$ and the MDST signal $X_s(k)$, and combines these portions to generate a complex signal.

[Math. 18]

$$X(k)=X_C(k)+j\cdot X_S(k),\ \text{for}\ k>f_{xover} \tag{18}$$

Figure 11:
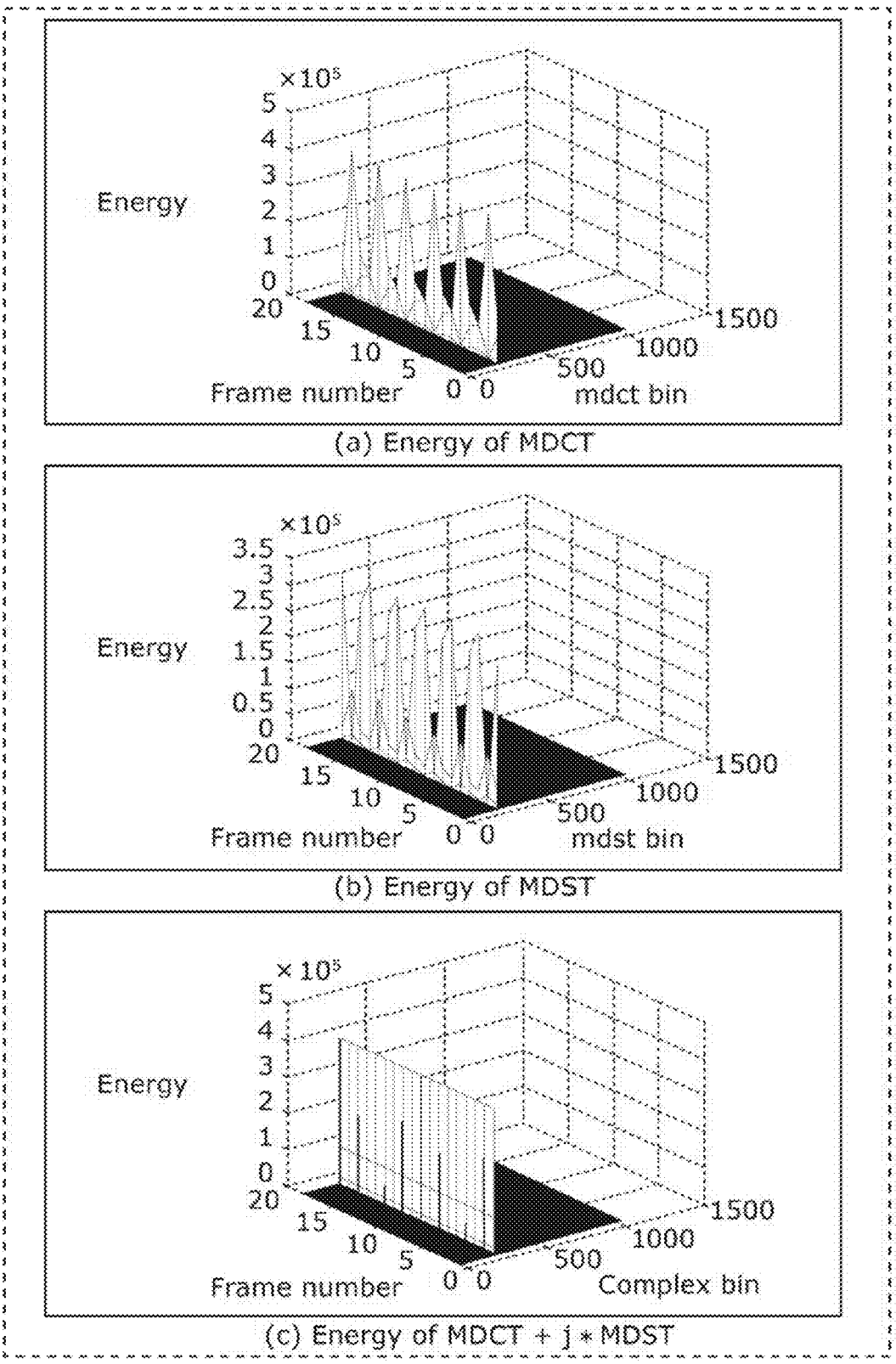
FIG. 11 illustrates energy of a pure tone in each of a modified discrete cosine transform (MDCT) domain, a modified discrete sine transform (MDST) domain, and a complex domain.

The derivation unit 604 cannot appropriately obtain tone energy from the MDCT signal or the MDST signal itself. Thus, the derivation unit 604 calculates a complex signal. The details are described with reference to FIG. 11. FIG. 11 illustrates the tone energy of 5 kHz pure tone components. (a) in FIG. 11 illustrates MDCT energy. (b) in FIG. 11 illustrates MDST energy. (c) in FIG. 11 illustrates complex energy.

In the examples in FIG. 11, the frame size is 1024 samples, and the sampling frequency is 48 kHz. As is clear from (a) and (b) in FIG. 11, tone energy in some frames is substantially smaller than tone energy in some other frames. Thus, if only one spectrum of spectra is used to derive tone components, a strong tone component would be missed.

Meanwhile, as (c) in FIG. 11 illustrates, tone energy (complex energy) of the same tone component is constant in all the frames in the complex signal.

The calculation unit 605 calculates a tone parameter and a floor parameter using the high-band signal x(k), where $k>f_{xover}$ (S306). The tone parameter indicates the magnitude of energy of tone components of the high-band signal x(k), where $k>f_{xover}$. The floor parameter indicates the magnitude of energy of floor components obtained by subtracting the tone components from the high-band signal x(k), where $k>f_{xover}$.

Details of a method of calculating the tone parameter and the floor parameter by the calculation unit 605 are described later.

The bitstream multiplexer 606 combines a tone parameter, a floor parameter, and a core parameter to generate a bitstream including these parameters, and outputs the bitstream to the decoding apparatus (S307).

The following describes details of a method of calculating the bandwidth extension parameters (tone parameter and floor parameter) by the calculation unit 605. The high-band signal x(k) where $k>f_{xover}$ is classified into a predetermined parameter band pb. This classification is similar to the classification described with reference to FIG. 5 in Embodiment 1. A difference is in that a time slot dimension does not exist in the MDCT domain. The calculation unit 605 calculates and quantizes one tone parameter and one floor parameter for each parameter band pb.

In Embodiment 3, the tone parameter is tone energy, and the floor parameter is floor energy. The calculation unit 605 calculates (estimates) the tone parameter and floor parameter as follows.

1. The calculation unit 605 calculates the energy of each frequency bin index k as follows.

[Math. 19]

$$E(k)=|X(k)|^2, \text{ for } k>f_{xover} \tag{19}$$

2. The calculation unit 605 finds the frequency bin index $k(k_T)$ satisfying the following expression.

[Math. 20]

$$k_T=\{k:(E(k)>c_1\cdot E(k-1))\hat{}(E(k)>c_1\cdot E(k+1))\} \tag{20}$$

3. The calculation unit 605 calculates tone energy $E_T(k)$ and floor energy $E_F(k)$ of each frequency bin index k as follows.

[Math. 21]

$$E_F(k)=\begin{cases} E(k), & k\notin k_T \\ 0.5\cdot(E(k-1)+E(k+1)), & k\in k_T \end{cases} \tag{21}$$

[Math. 22]

$$E_T(k)=\begin{cases} 0, & k\notin k_T \\ E(k)-E_F(k), & k\in k_T \end{cases} \tag{22}$$

4. The calculation unit 605 calculates the total tone energy of a parameter band pb as follows.

[Math. 23]

$$E_T(pb)=\sum_{k\in pb} E_T(k) \tag{23}$$

5. The calculation unit 605 calculates the total floor energy of a parameter band pb as follows.

[Math. 24]

$$E_F(pb)=\sum_{k\in pb} E_F(k) \tag{24}$$

The tone parameter and floor parameter calculated as above are quantized and transmitted to the decoding apparatus as a bitstream.

It should be noted that the above method of identifying tone components in the MDCT domain is only a mere example, and is not limited to such a method. The prior art discloses more advanced techniques for identifying tone components in the MDCT domain.

For instance, for higher reliability, tone components identified in a current frame may be compared with tone components found in a previous frame. In this case, only the tone components which appear in the same frequency bin index in both of the current and previous frames are regarded as "confirmed" tone components.

Moreover, for instance, not just the adjacent frequency bin indices of k−1 and k+1 but also indices such as k−2 and k+2 may be used as criteria for determining tone components at a frequency bin index k.

As described above, the encoding apparatus 100*b* according to Embodiment 3 can generate (encode) bandwidth extension parameters indicating magnitudes of tone energy and floor energy, also in the MDCT domain. The decoding apparatus can generate a bandwidth extension signal similar to the input signal in energy, tone-to-floor ratio, and harmonic structure, by using the bandwidth extension parameters.

Embodiment 4

Figure 12:
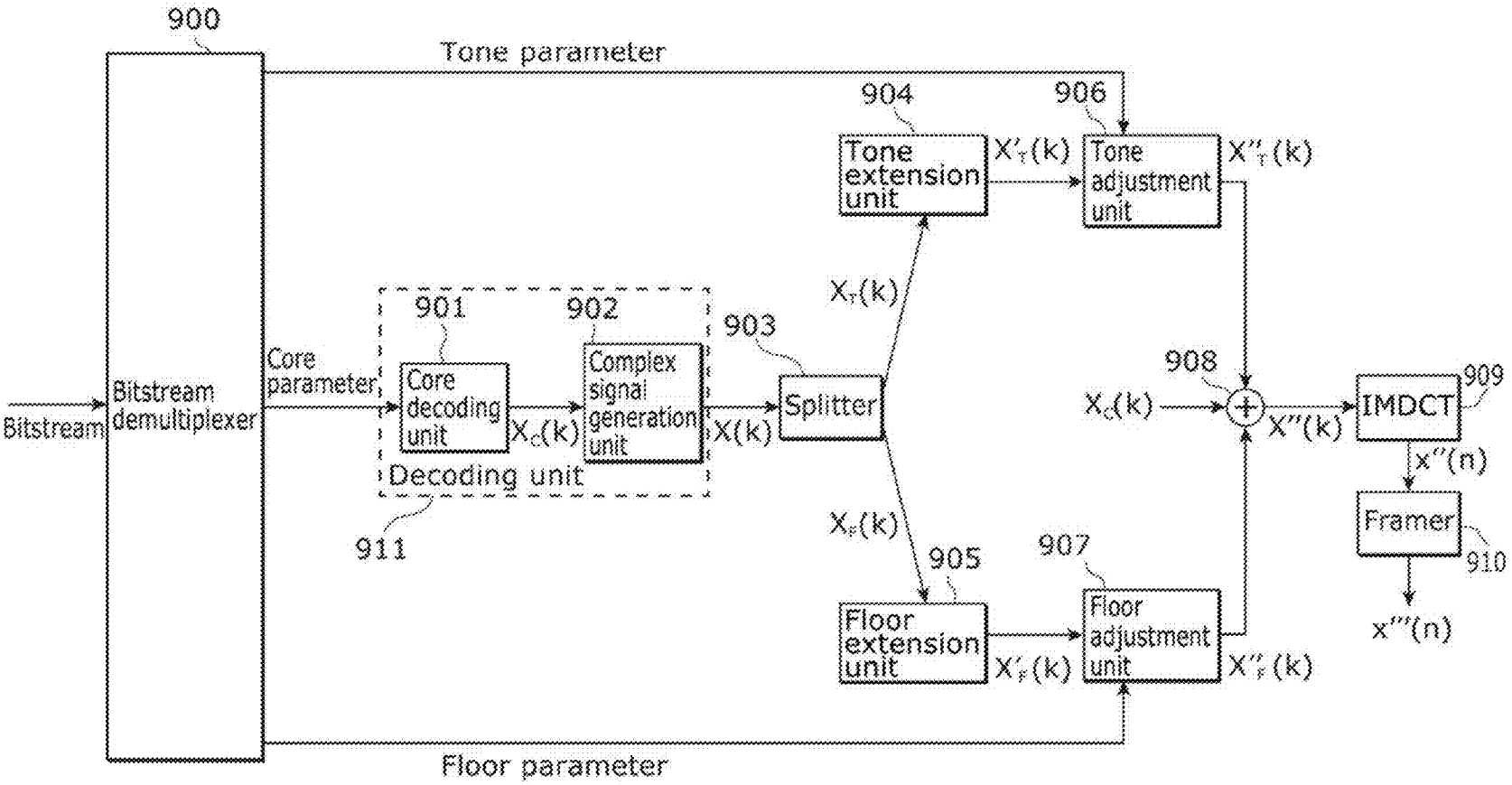
FIG. 12 is a block diagram illustrating a functional configuration of a decoding apparatus according to Embodiment 4.
Figure 13:
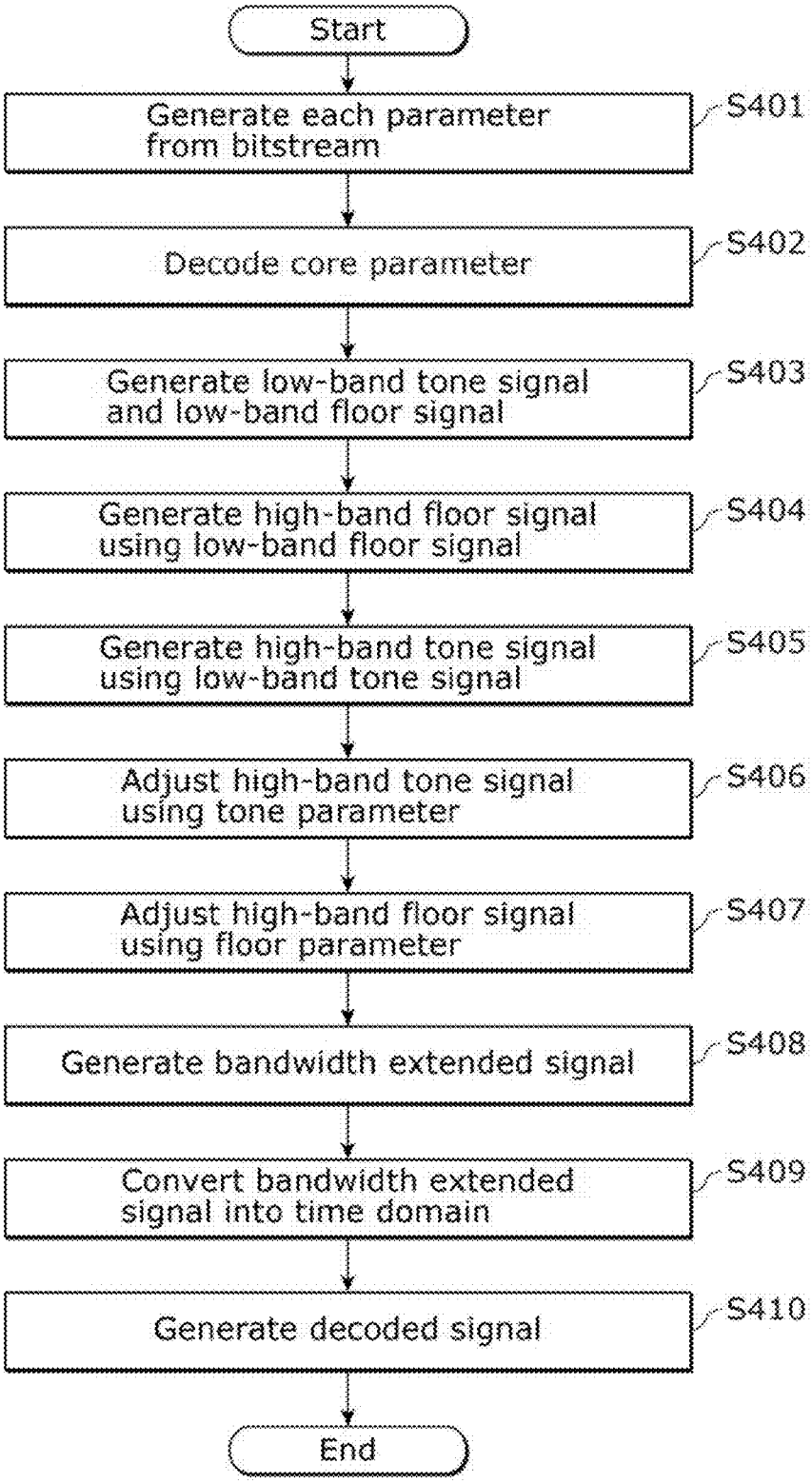
FIG. 13 is a flowchart of an operation of the decoding apparatus according to Embodiment 4.

Embodiment 4 describes a decoding apparatus corresponding to the encoding apparatus 100*b*. FIG. 12 is a block diagram illustrating a functional configuration of the decoding apparatus according to Embodiment 4. FIG. 13 is a flowchart of an operation of the decoding apparatus according to Embodiment 4.

As FIG. 12 illustrates, a decoding apparatus 200*b* includes a bitstream demultiplexer 900, a decoding unit 911 (a core decoding unit 901 and a complex signal generation unit 902), a splitter 903, a tone extension unit 904, a floor extension unit 905, a tone adjustment unit 906, a floor adjustment unit 907, an addition unit 908, an IMDCT unit 909, and a framer 910.

The bitstream demultiplexer 900 unpacks a bitstream to generate (derive) a tone parameter, a floor parameter, and a core parameter (S401).

The decoding unit 911 decodes the core parameter to generate a decoded narrowband signal X(k) (S402).

Specifically, the core decoding unit 901 decodes the core parameter to generate an MDCT signal $X_c(k)$. That is, the MDCT signal is obtained from the core parameter. The MDCT decoding method of the prior art used in the AAC and others is used by the core decoding unit 901.

The complex signal generation unit 902 transforms the MDCT signal $X_c(k)$ into an MDST domain to generate an MDST signal $X_s(k)$. The MDCT to MDST conversion method of the prior art (e.g., Non Patent Literature 4) is applicable as a method for transforming the MDCT signal $X_c(k)$ into the MDST domain to generate the MDST signal $X_s(k)$.

The complex signal generation unit 902 generates a complex signal using the MDCT signal $X_c(k)$ and the MDST signal $X_s(k)$ as follows.

[Math. 25]

$$X(k)=X_C(k)+j\cdot X_S(k) \tag{25}$$

It should be noted that the complex signal X(k) is a decoded narrowband signal whose upper limit of a bandwidth is $f_{xover}$.

The splitter 903 generates a low-band tone signal representing the tone components of the decoded narrowband signal X(k) and a low-band floor signal representing the floor components of the decoded narrowband signal X(k) (S403). Specifically, the splitter 503 splits the decoded narrowband signal X(k) into a low-band tone signal $X_T(k)$ and a low-band floor signal $X_F(k)$. In Embodiment 4, the signal is split as follows.

1. The splitter 903 calculates a tone component $k_T$, total energy E(k), tone energy $E_T(k)$, and floor energy $E_F(k)$ for each frequency bin index k, using expressions (19) to (22) described in Embodiment 3.

2. The splitter 903 derives the low-band tone signal $X_T(k)$ and low-band floor signal $X_F(k)$ as follows. The splitter 903 splits the decoded narrowband signal X(k) into the low-band tone signal $X_T(k)$ and low-band floor signal $X_F(k)$ according to the magnitude of energy.

[Math. 26]

$$X_T(k) = \sqrt{\frac{E_T(k)}{E(k)}}\, X(k) \tag{26}$$

[Math. 27]

$$X_F(k) = \sqrt{\frac{E_F(k)}{E(k)}}\, X(k) \tag{27}$$

3. The splitter 903 selects $N_T$ tone subsets $k_{T2}$ In descending order of tone energy from among frequency bin indices $k_T$. It should be noted that as the modification example, the splitter 903 may use only the frequency bin index of a frequency higher than a predetermined frequency in harmonic extension to prevent overly dense harmonic distribution.

Moreover, the tone subsets may be selected by the tone extension unit 904. That is, the tone extension unit 904 may select, from among frequency bins k of a low-band tone signal, frequency bins k ($k_T$ and $k_{T2}$) each having tone components whose energy is greater than a predetermined multiple of energy of the tone components of an adjacent frequency bin.

The floor extension unit 905 generates a high-band floor signal corresponding to the floor components of a high-band signal (i.e., the high-band portion of an input unit), using the low-band floor signal $X_F(k)$ (S404). The floor extension unit 905 generates a high-band floor signal (patched floor signal) $X'_F(k)$ by patching the low-band floor signal $X_F(k)$ to a high-frequency portion. Specifically, for example, the copy-up techniques used in the HE-AAC and others are applicable.

If the function map( ) is a patching function which copies a frequency bin index of map(k) onto a frequency bin index k in a high-frequency domain, the patching is represented by the following expression.

[Math. 28]

$$X'_F(k)=X_F(ts,\mathrm{map}(k)),\ \text{for } k=f_{xover} \tag{28}$$

The tone extension unit 904 generates a high-band tone signal (extended tone signal) corresponding to tone components of the high-band signal (i.e., the high-band portion of the input signal), using the low-band tone signal $X_T(k)$ (S405). Specifically, the tone extension unit 904 generates the high-band tone signal $X'_T(k)$ by harmonically extending the low-band tone signal $X_T(k)$ to a high-frequency domain.

In Embodiment 4, the tone extension unit 904 uses the following harmonic extension method. It should be noted that the harmonic extension method is applied to the frequency bin index $k_T$ in the following description. However, the harmonic extension method may be applied to the tone subset $k_{T2}$.

1. The tone extension unit 904 replicates (copies) strong tone components at a tone subset $k_T$ onto a high-frequency domain, according to integer harmonic ratios (e.g., 2, 3, 4). That is, the tone extension unit 904 generates a high-band tone signal by replicating a low-band tone signal of a selected frequency bin (tone subset $k_T$) onto a frequency bin which is an integral multiple of the selected frequency bin. The following pseudo code indicates a replication operation.

It should be noted that in the following expression, the upper limit of the replication is a maximum harmonic $\text{ratio}_{max}$ (e.g., 4).

[Math. 29]

$$\boxed{\begin{array}{l} X'_T(k) = 0; \\ \text{for } k \in k_T \\ \text{for } i = 2 \text{ to } ratio_{max} \text{ // integer harmonic ratios 2, 3, 4, … etc} \\ \text{if}(k \cdot i > f_{xover}) \\ X'_T(k \cdot i) = X'_T(k \cdot i) + X_T(k) \\ \text{end} \\ \text{end} \end{array}} \tag{29}$$

4. A copy-up method using the same map(k) function used by the floor extension unit 905 is applied to a frequency bin index without a tone component.

Here, the tone components of the tone subset $k_T$ have been replicated onto a high-frequency domain by the above harmonic extension method. Thus, the tone components are not patched again by the copy-up method.

[Math. 30]

$$X'_T(k)=X_T(\mathrm{map}(k)),$$

$$\text{for } k\in\{k:k>f_{xover}, X'_T(k)=0, \mathrm{map}(k)\notin k_T\} \tag{30}$$

Thus, the tone extension unit 904 generates, as a high-band tone signal, a signal representing the harmonic components of the tone components of the low-band tone signal.

The tone adjustment unit 906 adjusts the high-band tone signal $X'_T(k)$ using a tone parameter (S406) to generate an adjusted tone signal $X''_T(k)$. In Embodiment 4, the tone parameter is tone energy $E_T(pb)$ defined for each parameter band pb, and the high-band tone signal $X'_T(k)$ is adjusted as follows.

[Math. 31]

$$X''_T(k) = X'_T(k) \cdot \sqrt{\frac{E_T(pb)}{\sum_{k\in pb} |X'_T(k)|^2}} \tag{31}$$

That is, the tone adjustment unit 906 adjusts the energy of high-band tone signal $X'_T(k)$ to tone energy indicated by the tone parameter, to generate the adjusted tone signal $X''_T(k)$.

If the decoded narrowband signal X(k) itself is not tonal, the high-band tone signal $X'_T(k)$ does not have tone components in the parameter band pb in some cases. In such cases, prior to adjustment by the tone adjustment unit 906, artificial harmonic components can be injected into the center of the parameter band. The following describes examples.

Daudet et al. (Non Patent Literature 5) describes that the MDCT spectrum of a pure sine wave tone is a product of a shifted sinc( ) function and a shifted cosine modulation. Based on this analysis, the following signal must be injected into a frequency bin index section [k−2, k+2] to inject a sine wave tone in the center of frequency bin index k. Here, fr is the frame index.

[Math. 32]

$$X'_T(k-i) = \frac{1}{(1-2i)(1+2i)}\left(\sqrt{-1}\right)^{(fr\bmod 4)+i}, \quad i = -2, -1, 0, 1, 2 \tag{32}$$

It should be noted that the injection into the section of k−2 and k+2 may be skipped to reduce complexity. Thus, the sound quality slightly decreases. However, because of their low amplitudes, k−2 and k+2 have only limited degradation effects on the sound quality.

The floor adjustment unit 907 adjusts the high-band floor signal $X'_F(k)$ using the floor parameter to generate the adjusted floor signal $X''_F(k)$ (S407). In Embodiment 4, the floor parameter is floor energy $E_F(k)$ defined for each parameter band pb, and the high-band floor signal $X'_F(k)$ is adjusted as follows.

[Math. 33]

$$X''_F(k) = X'_F(k)\cdot\sqrt{\frac{E_F(pb)}{\sum_{k\in pb}|X'_F(k)|^2}} \tag{33}$$

That is, the floor adjustment unit 907 adjusts the energy of the high-band floor signal $X'_F(k)$ to energy indicated by the floor parameter, to generate the adjusted high-band floor signal $X''_F(k)$.

The addition unit 908 adds the MDCT signal $X_c(k)$, the real part of the adjusted tone signal $X''_T(k)$, and the real part of the adjusted floor signal $X''_F(k)$, to generate a bandwidth extension signal X"(k) (S408).

[Math. 34]

$$X''(k)=X_C(k)+Re\{X''_T(k)+X''_F(k)\} \tag{34}$$

The IMDCT unit 909 transforms (inversely transforms) the bandwidth extension signal X"(k) into a time domain signal x"(n) (S409).

The framer 910 performs windowing and addition of an overlap on the time domain signal x"(n), to generate a decoded signal x'"(n) (S410). (b) in FIG. 10 described in Embodiment 3 illustrates an operation by the framer 910.

As described above, the decoding apparatus 200*b* according to Embodiment 4 can maintain harmonic sound quality of an input signal (original signal) by harmonically extending strong tone components and synthesizing the extended tone components with simply replicated floor components.

Moreover, in the bandwidth extension method performed by the decoding apparatus 200*b*, critical sampling, time-stretching, and resampling (down sampling) used in the harmonic method of the prior art are inessential. Thus, according to the bandwidth extension method performed by the decoding apparatus 200*b*, complexity, delay, and memory requirements can be reduced.

OTHER EMBODIMENTS

The present disclosure may be achieved as a bandwidth extension parameter generation device.

The processing order of the steps in each flowchart described in the above embodiments is a mere example, and may be changed in a feasible range. Moreover, parallel processable steps may be processed in parallel.

Moreover, in each embodiment, each structural element may be a dedicated hardware, or achieved by executing a software program suitable for the structural element. Each structural element may be achieved by a program executing unit such as a CPU or a processor reading and executing a software program stored in a recording medium such as a hard disk or a semiconductor memory.

CONCLUSION

The bandwidth extension parameter generation devices and encoding apparatuses according to the above embodiments estimate the tone energy and floor energy of the high-band portion of an input signal, and generate bandwidth extension parameters indicating the magnitudes of the tone energy and floor energy.

The decoding apparatuses according to the above embodiments select and derive strong tone components from a decoded narrowband signal, and harmonically extend the derived tone components to a high-frequency domain. Using the copy-up mode, the decoding apparatus replicates, as the high-frequency domain, the remaining floor components, i.e., components obtained by subtracting the derived tone components from the decoded narrowband signal.

Moreover, the decoding apparatus adjust the derived tone components and the replicated tone components, using the bandwidth extension parameters generated by the encoding apparatus so that these components have the same tone energy and the tone-to-floor ratio as the components of an input signal.

The bandwidth extension methods according to the above embodiments are basically simple extension in the copy-up method with low complexity. Thus, critical sampling, time-stretching, and resampling, which are required by the harmonic methods of the prior art, are inessential. Thus, complexity, delay, and memory are significantly improved.

Thus, the bandwidth extension parameter generation device(s), encoding apparatus(es), and decoding apparatus(es) according to one or more than one aspect are described above. However, the present disclosure is not limited to the embodiment(s). The one or more than one aspect may include an embodiment obtained by making various modifications which those skilled in the art would conceive or an embodiment obtained by combining structural elements in different embodiments, unless these embodiments do not depart from the scope of the present disclosure.

It should be noted that to illustrate the above techniques, the structural elements illustrated in the appended drawings and mentioned in the detailed description include structural elements both essential and inessential for addressing the problems. In view of this, the appearance of these inessential structural elements in the appended drawings and the detailed description does not directly mean that these inessential structural elements are essential.

The herein disclosed subject matter is to be considered descriptive and illustrative only, and the appended Claims are of a scope intended to cover and encompass not only the particular embodiment(s) disclosed, but also equivalent structures, methods, and/or use.

INDUSTRIAL APPLICABILITY

The present disclosure is applicable to applications concerning encoding and decoding of a sound signal. The present disclosure is applicable to applications such as audio books, broadcasting systems, portable media devices, mobile communication terminals (including cellular phones and tablets), teleconference devices, and networked music performances.

The invention claimed is:

1. A decoding apparatus for decoding a bitstream including a core parameter, a tone parameter, and a floor parameter, the core parameter being a low-band portion of an encoded input sound signal, the tone parameter indicating a magnitude of energy of a tone component of a high-band signal, the floor parameter indicating a magnitude of energy of a floor component obtained by subtracting the tone component from the high-band signal, the high-band signal representing a high-band portion of the encoded input sound signal, the decoding apparatus comprising at least one processor which:

decodes the core parameter to generate a decoded narrowband signal;

performs a QMF analysis to convert the decoded narrowband signal into a subband signal;

generates, by splitting the subband signal, a low-band tone signal representing a tone component of the decoded narrowband signal and a low-band floor signal representing a floor component of the decoded narrowband signal;

generates a high-band tone signal corresponding to the tone component of the high-band signal, using the low-band tone signal;

generates a high-band floor signal corresponding to the floor component of the high-band signal, using the low-band floor signal;

selects, from among subbands of the low-band tone signal, a subband having a tone component whose energy is (i) greater than a predetermined multiple of energy of a tone component of an adjacent subband and (ii) greater than a predetermined multiple of energy of a floor component of the selected subband, and replicates the low-band tone signal corresponding to the selected subband onto a subband which is an integral multiple of the selected subband, to generate the high-band tone signal;

adjusts the high-band tone signal using the tone parameter to generate an adjusted tone signal;

adjusts the high-band floor signal using the floor parameter to generate an adjusted floor signal; and adds the subband signal obtained from the core parameter, the adjusted tone signal, and the adjusted floor signal, to generate a bandwidth extended signal.

2. The decoding apparatus according to claim 1, wherein the at least one processor generates, as the high-band tone signal, a signal representing a harmonic component of a tone component of the low-band tone signal.

3. The decoding apparatus according to claim 1, wherein the at least one processor further:

generates the tone parameter, the floor parameter, and the core parameter from the bitstream; and performs a QMF synthesis to convert the bandwidth extended signal into a time domain.

4. A decoding apparatus for decoding a bitstream including a core parameter, a tone parameter, and a floor parameter, the core parameter being a low-band portion of an encoded input sound signal, the tone parameter indicating a magnitude of energy of a tone component of a high-band signal, the floor parameter indicating a magnitude of energy of a floor component obtained by subtracting the tone component from the high-band signal, the high-band signal representing a high-band portion of the encoded input sound signal, the decoding apparatus comprising at least one processor which:

decodes the core parameter to generate an MDCT signal;

converts the MDCT signal into an MDST domain to generate an MDST signal;

generates a complex signal from the MDCT signal and the MDST signal, as a decoded narrowband signal;

generates a low-band tone signal representing a tone component of the decoded narrowband signal and a low-band floor signal representing a floor component of the decoded narrowband signal;

generates a high-band tone signal corresponding to the tone component of the high-band signal, using the low-band tone signal;

generates a high-band floor signal corresponding to the floor component of the high-band signal, using the low-band floor signal;

adjusts the high-band tone signal using the tone parameter to generate an adjusted tone signal;

adjusts the high-band floor signal using the floor parameter to generate an adjusted floor signal; and adds the MDCT signal obtained from the core parameter, the adjusted tone signal, and the adjusted floor signal, to generate the bandwidth extended signal.

5. The decoding apparatus according to claim 4, wherein the at least one processor selects, from among frequency bins of the low-band tone signal, a frequency bin having a tone component whose energy is greater than a predetermined multiple of energy of a tone component of an adjacent frequency bin, and replicates the low-band tone signal corresponding to the selected frequency bin onto a frequency bin which is an integral multiple of the selected frequency bin, to generate the high-band tone signal.

6. The decoding apparatus according to claim 4, wherein the at least one processor further:

generates the tone parameter, the floor parameter, and the core parameter from the bitstream; and performs an inverse modified discrete cosine transform (IMDCT) to convert the bandwidth extended signal into a time domain.

7. A method for decoding a bitstream including a core parameter, a tone parameter, and a floor parameter, the core parameter being a low-band portion of an encoded input sound signal, the tone parameter indicating a magnitude of energy of a tone component of a high-band signal, the floor parameter indicating a magnitude of energy of a floor component obtained by subtracting the tone component from the high-band signal, the high-band signal representing a high-band portion of the encoded input sound signal, the method comprising:

decoding the core parameter to generate a decoded narrowband signal;

performing a QMF analysis to convert the decoded narrowband signal into a subband signal;

generating, by splitting the subband signal, a low-band tone signal representing a tone component of the decoded narrowband signal and a low-band floor signal representing a floor component of the decoded narrowband signal;

generating a high-band tone signal corresponding to the tone component of the high-band signal, using the low-band tone signal;

generating a high-band floor signal corresponding to the floor component of the high-band signal, using the low-band floor signal;

selecting, from among subbands of the low-band tone signal, a subband having a tone component whose energy is (i) greater than a predetermined multiple of energy of a tone component of an adjacent subband and (ii) greater than a predetermined multiple of energy of a floor component of the selected subband, and replicating the low-band tone signal corresponding to the selected subband onto a subband which is an integral multiple of the selected subband, to generate the high-band tone signal;

adjusting the high-band tone signal using the tone parameter to generate an adjusted tone signal;

adjusting the high-band floor signal using the floor parameter to generate an adjusted floor signal; and adding the subband signal obtained from the core parameter, the adjusted tone signal, and the adjusted floor signal, to generate a bandwidth extended signal.

8. A decoding method for decoding a bitstream including a core parameter, a tone parameter, and a floor parameter, the core parameter being a low-band portion of an encoded input sound signal, the tone parameter indicating a magnitude of energy of a tone component of a high-band signal, the floor parameter indicating a magnitude of energy of a floor component obtained by subtracting the tone component from the high-band signal, the high-band signal representing a high-band portion of the encoded input sound signal, the method comprising:

decoding the core parameter to generate an MDCT signal;

converting the MDCT signal into an MDST domain to generate an MDST signal;

generating a complex signal from the MDCT signal and the MDST signal, as a decoded narrowband signal;

generating a low-band tone signal representing a tone component of the decoded narrowband signal and a low-band floor signal representing a floor component of the decoded narrowband signal;

generating a high-band tone signal corresponding to the tone component of the high-band signal, using the low-band tone signal;

generating a high-band floor signal corresponding to the floor component of the high-band signal, using the low-band floor signal;

adjusting the high-band tone signal using the tone parameter to generate an adjusted tone signal;

adjusting the high-band floor signal using the floor parameter to generate an adjusted floor signal; and adding the MDCT signal obtained from the core parameter, the adjusted tone signal, and the adjusted floor signal, to generate a bandwidth extended signal.

* * * * *